US012560373B2

(12) United States Patent
Lee et al.

(10) Patent No.: US 12,560,373 B2
(45) Date of Patent: Feb. 24, 2026

(54) REFRIGERATOR

(71) Applicant: SAMSUNG ELECTRONICS CO., LTD., Suwon-si (KR)

(72) Inventors: Chomin Lee, Suwon-si (KR); Seangwon Lee, Suwon-si (KR); Jaejin Lee, Suwon-si (KR); Jeonghun Shin, Suwon-si (KR); Wooyeol Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 89 days.

(21) Appl. No.: 18/233,677

(22) Filed: Aug. 14, 2023

(65) Prior Publication Data

US 2024/0053087 A1 Feb. 15, 2024

Related U.S. Application Data

(63) Continuation of application No. PCT/KR2023/011337, filed on Aug. 2, 2023.

(30) Foreign Application Priority Data

Aug. 11, 2022 (KR) ..... 10-2022-0100904
Oct. 31, 2022 (KR) ..... 10-2022-0142850

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01)

(58) Field of Classification Search
CPC ..... F25D 23/028; F25D 23/02; F25D 29/005; F25D 29/00; F25D 2400/361;
(Continued)

(56) References Cited

U.S. PATENT DOCUMENTS 5,437,503 A * 8/1995 Baker ..... A47B 88/944 312/348.4
8,523,302 B2 9/2013 Shin et al.
(Continued)

FOREIGN PATENT DOCUMENTS

CN 210154172 U 3/2020
EP 3 037 758 B1 6/2021
(Continued)

OTHER PUBLICATIONS

CN210154172 translation (Year: 2020).*
(Continued)

*Primary Examiner* — Hiwot E Tefera
(74) *Attorney, Agent, or Firm* — Sughrue Mion, PLLC

(57) ABSTRACT

A refrigerator includes: a main body including a storage compartment; a door rotatably coupled to the main body and configured to open and close the storage compartment; and a door opening device provided in the main body and including a drive motor, the door opening device being configured to open the door, wherein the door includes: a door front member forming a front surface of the door; a door side member forming a side surface of the door and having an opening; a side cap coupled to an inner surface of the door side member and including a handle that is recessed and a switch mounting space; and a switch module mounted in the switch mounting space through the opening and configured to receive an input for operating the door opening device.

14 Claims, 27 Drawing Sheets

(58) Field of Classification Search
CPC .... F25D 2400/18; E05F 15/619; E05F 15/75; E05F 15/614; E05F 15/616; E05B 1/0015; E05B 1/00; E05B 17/0029; E05B 17/0033; A47B 95/02; E05Y 2201/426
See application file for complete search history.

(56) References Cited

U.S. PATENT DOCUMENTS

| | | | | |
|---|---|---|---|---|
| 9,745,788 | B2 | 8/2017 | Becker et al. | |
| 10,030,904 | B2 * | 7/2018 | Becke | F25D 29/005 |
| 10,215,473 | B2 * | 2/2019 | Ding | F25D 23/028 |
| 10,429,126 | B2 | 10/2019 | Park | |
| 10,907,884 | B1 * | 2/2021 | Scorsim | F25D 23/028 |
| 11,056,051 | B2 | 7/2021 | Kim et al. | |
| 11,859,429 | B2 | 1/2024 | Shin et al. | |
| 2008/0231159 | A1 * | 9/2008 | Lee | F25D 23/02 312/405 |
| 2011/0048060 | A1 | 3/2011 | Kim et al. | |
| 2011/0273071 | A1 * | 11/2011 | Kim | F25D 23/028 312/405 |
| 2013/0113357 | A1 * | 5/2013 | Park | E05B 1/0015 312/405 |
| 2014/0265805 | A1 | 9/2014 | Chamberlin | |
| 2015/0052920 | A1 * | 2/2015 | Park | F25D 29/003 62/126 |
| 2016/0312516 | A1 * | 10/2016 | Heydel | E05F 15/614 |
| 2017/0184336 | A1 * | 6/2017 | Becke | F25D 23/028 |
| 2017/0191737 | A1 * | 7/2017 | Becke | F25D 23/028 |
| 2018/0051926 | A1 * | 2/2018 | Lu | F25D 29/005 |
| 2018/0135333 | A1 * | 5/2018 | Viswanathan | F25D 29/005 |
| 2019/0186809 | A1 | 6/2019 | Scalf et al. | |
| 2021/0041160 | A1 * | 2/2021 | Feldmeyer | F25D 25/025 |
| 2022/0146184 | A1 * | 5/2022 | Motoi | F25D 23/02 |
| 2022/0214096 | A1 * | 7/2022 | Han | E05B 7/00 |

FOREIGN PATENT DOCUMENTS

| | | | | |
|---|---|---|---|---|
| JP | 2005-11773 | A | 1/2005 | |
| JP | 2005-344977 | A | 12/2005 | |
| JP | 6584164 | B2 | 10/2019 | |
| JP | 6704468 | B2 | 6/2020 | |
| KR | 20-0167025 | Y1 | 1/2000 | |
| KR | 10-2006-0083552 | A | 7/2006 | |
| KR | 10-0740800 | B1 | 7/2007 | |
| KR | 10-1203424 | B1 | 11/2012 | |
| KR | 10-1409605 | B1 | 6/2014 | |
| KR | 10-1650307 | B1 | 9/2016 | |
| KR | 10-1972547 | B1 | 4/2019 | |
| KR | 10-2002117 | B1 | 7/2019 | |
| KR | 10-2012487 | B1 | 8/2019 | |
| KR | 10-2020-0135566 | A1 | 12/2020 | |
| WO | WO-2013107662 | A2 * | 7/2013 | F25D 23/028 |
| WO | 2021/256677 | A1 | 12/2021 | |

OTHER PUBLICATIONS

JP6704468 translation (Year: 2020).*
JP 6584164 translation (Year: 2019).*
WO2013107662 translation (Year: 2013).*
Communication dated Nov. 21, 2023, issued by the International Searching Authority in counterpart International Application No. PCT/KR2023/011337 (PCT/ISA/210).
Communication dated Nov. 21, 2023, issued by the International Searching Authority in counterpart International Application No. PCT/KR2023/011337 (PCT/ISA/237).
Communication issued on Jun. 13, 2025 by the European Patent Office in European Patent Application No. 23852870.7.

* cited by examiner

REFRIGERATOR

CROSS-REFERENCE TO RELATED APPLICATIONS

This application is a by-pass continuation of International Application No. PCT/KR2023/011337, filed on Aug. 2, 2023, which is based on and claims priority to Korean Patent Application Nos. 10-2022-0100904, filed on Aug. 11, 2022, and 10-2022-0142850, filed on Oct. 31, 2022, in the Korean Intellectual Property Office, the disclosures of which are incorporated by reference herein in their entireties

BACKGROUND

1. Field

The disclosure relates to a refrigerator including a door opening device configured to open a door and a switch module configured to operate the door opening device.

2. Description of Related Art

A refrigerator is a home appliance that keeps food fresh by including a main body including a storage compartment, a cold air supply device configured to supply cold air to the storage compartment, and a door configured to open and close the storage compartment.

The refrigerator may be provided with a door opening device that helps to open the door comfortably and a switch module configured to operate the door opening device. A user can operate the door opening device by manipulating the switch module.

SUMMARY

Provided is a refrigerator including a door opening device capable of opening a plurality of doors disposed in left and right directions and a switch module capable of operating the door opening device.

Further, provided is a refrigerator including a switch module having an improved assembly convenience and an improved use convenience.

Additional aspects of the disclosure will be set forth in part in the description which follows and, in part, will be apparent from the description, or may be learned by practice of the presented embodiments.

Technical Solution

A refrigerator includes: a main body including a storage compartment; a door rotatably coupled to the main body and configured to open and close the storage compartment; and a door opening device provided in the main body and configured to open the door, wherein the door includes: a door front member forming a front surface of the door; a door side member forming a side surface of the door and having an opening; a side cap coupled to an inner surface of the door side member and including a handle that is recessed and a switch mounting space; and a switch module mounted in the switch mounting space through the opening and configured to receive an input for operating the door opening device.

At least a portion of the switch module may protrude outward from the door side member.

The switch module may cover the opening.

The refrigerator may further include a fastening member penetrating the door front member and coupling the switch module to the door front member.

The switch module may include an end coupler into which an end of the door side member is coupled.

The switch module may include: a circuit board configured to output a door opening signal according to a change in a capacitance; and a switch case to which the circuit board is mounted, and covering the opening.

The switch module may further include a transfer member between the circuit board and the switch case and electrically connecting the circuit board and the switch case.

The switch case may include: a first switch case including a board mounting member on which the circuit board is mounted, the first switch case contacting the transfer member; and a second switch case coupled to the first switch case and covering the opening.

The second switch case may include a touch surface configured to be touched when a user holds the handle, and the touch surface may include a curved surface in which an amount of protrusion from the door side member is reduced from a front end to a rear end of the touch surface.

The first switch case may include a touch protrusion which penetrates the second switch case and is exposed to an outside of the second switch case.

The opening is a first opening, and the door side member may include a second opening formed behind the first opening, and the handle may be accessible through the second opening.

The door side member may include a bending member protruding toward an inside of the door from one edge of the second opening, and the side cap may include a side cap groove configured to allow the bending member to be inserted thereinto.

The bending member may include a bending member hole, and the side cap may further include a side cap protrusion in the side cap groove to be coupled to the bending member hole.

The refrigerator may further include: a front panel detachably coupled to a front side of the door, and the switch module is exposed without being covered by the front panel when the front panel is coupled the front side of the door.

The refrigerator may further include: a front panel detachably coupled to a front side of the door, and the fastening member may be covered by the front panel when the front panel is coupled to the front side of the door.

According to an aspect of the disclosure, a refrigerator includes: a main body including a storage compartment; a first door and a second door that are rotatably coupled to the main body and disposed on left and right sides of the storage compartment, the first door and the second door being configured to open and close the storage compartment; and a door opening device provided in the main body and configured to open the first door and the second door; wherein the first door includes: a first side surface provided to face the second door when the first door and the second door are closed; a first handle recessed into the first side surface; and a first switch module provided on the first side surface and configured to receive an input for operating the door opening device to open the first door, and wherein the second door includes: a second side surface provided to face the first door when the first door and the second door are closed; a second handle recessed into the second side surface; and a second switch module provided on the second side surface and configured to receive an input for operating the door opening device to open the second door.

The first switch module and the second switch module may be located at different heights.

A portion of the first switch module may protrude from the first side surface; and a portion of the second switch module may protrude from the second side surface.

According to an aspect of the disclosure, a refrigerator includes: a main body including a storage compartment; a door rotatably coupled to the main body and configured to open and close the storage compartment; a front panel detachably coupleable to a front side of the door; and a door opening device provided in the main body and configured to open the door; wherein the door includes: a handle recessed into a side surface of the door; and a switch module provided on the side surface of the door and configured to receive an input for operating the door opening device, wherein the switch module is exposed without being covered by the front panel.

The refrigerator may further include a fastening member penetrating a front surface of the door and coupling the switch module to the front surface of the door, and the fastening may be is covered by the front panel when the front panel is coupled to the front side of the door.

As is apparent from the above description, a plurality of doors arranged in left and right directions may be opened through a door opening device including one motor, and thus material costs may be reduced and an assembly structure may be simplified.

Further, a switch module for operating a door opening device may be easily assembled and the convenience of use may be improved.

The effects of the present disclosure are not limited to those mentioned above, and other effects not mentioned will be apparent from the following description to one of ordinary skill in the art to which the present disclosure belongs.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
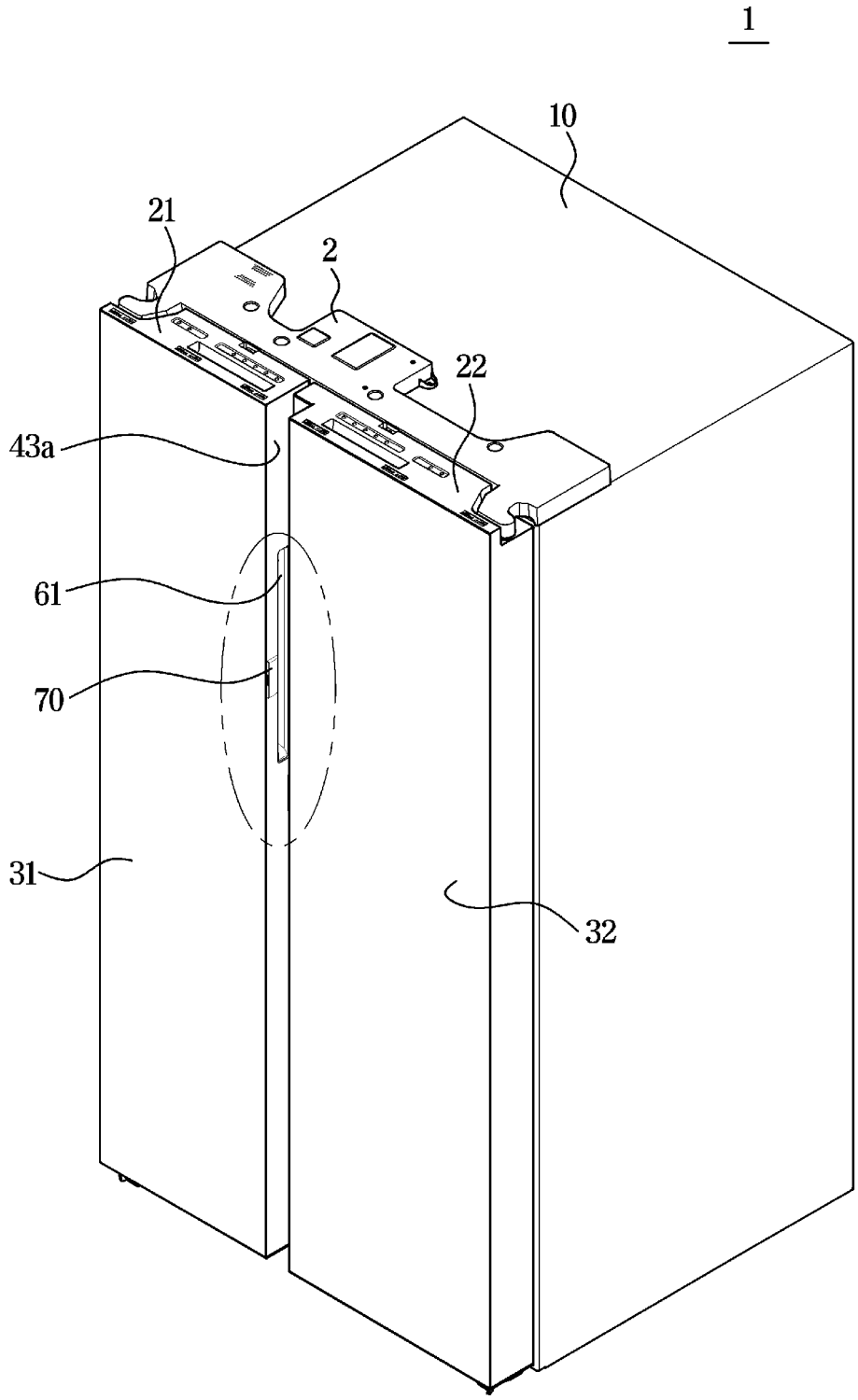
FIG. 1 is a view illustrating an appearance of a refrigerator according to an embodiment of the disclosure.

The various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless they are definitely different in a context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (e.g., importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In the following detailed description, the terms of "front surface", "rear surface", "upper surface", "lower surface", "side surface" "left side", "right side", "upper portion", "lower portion" and the like may be defined by the drawings, but the shape and the location of the component is not limited by the term.

In this disclosure, the terms "including", "comprising", and the like are used to specify features, numbers, steps, operations, elements, elements, or combinations thereof, but do not preclude the presence or addition of one or more of the features, elements, steps, operations, elements, elements, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

A refrigerator according to an embodiment may include a main body.

The "main body" may include an inner case and an outer case disposed outside the inner case, and an insulating material provided between the inner case and the outer case.

The "inner case" may include a case, a plate, a panel or a liner that forms a storage compartment. The inner case may be formed as a single body or may be formed by assembling a plurality of plates. The "outer case" may form an exterior of the main body, and may be coupled to the outer side of the inner case to allow an insulating material to be disposed between the inner case and the outer case.

The "insulating material" may insulate the inside and outside of the storage compartment to allow a temperature inside the storage compartment to be maintained at a set appropriate temperature without being affected by the external environment of the storage compartment. According to an embodiment, the insulating material may include a foam insulating material. After fixing the inner and outer cases with ajig or the like, a foam insulating material may be molded by injecting and foaming urethane foam, in which polyurethane and a foaming agent are mixed, between the inner and outer cases.

According to an embodiment, the insulating material may include a vacuum insulating material in addition to the foam insulating material, or the insulating material may include only a vacuum insulating material instead of the foam insulating material. The vacuum insulating material may include a core material and an outer covering material that accommodates the core material and seals an inside with a vacuum or a pressure close to the vacuum. The vacuum insulating material may further include an adsorbent that adsorbs gas and moisture to stably maintain a vacuum state.

However, the insulating material is not limited to the above-described foam insulating material or vacuum insulating material, and may include various materials that may be used for insulation.

The refrigerator according to an embodiment may include a storage compartment provided inside the main body to store food.

The "storage compartment" may include a space defined by the inner case. The storage compartment may further include an inner case provided to define the space. The storage compartment may be formed to allow at least one side thereof to be opened in order to remove and add food. The storage compartment may be provided to store "food". Food includes food that may be eaten or drunk, and specifically, may include meat, fish, seafood, fruits, vegetables, water, ice, beverages, kimchi or alcoholic beverages such as wine. However, in addition to food, medicines or cosmetics may be stored in the storage compartment, and there is no limitation on the items that may be stored in the storage compartment.

The refrigerator may include one or more storage compartments. When two or more storage compartments are formed in the refrigerator, each storage compartment may have a different purpose and may be maintained at different temperatures. For this, each of the storage compartments may be partitioned from each other by a partition wall including the insulating material. According to an embodiment, the partition wall may be a part of the main body. According to an embodiment, the partition wall may be a separate partition provided separately from the main body, and assembled to the main body.

The storage compartment may be maintained in an appropriate temperature range according to the purpose, and may include a "refrigerating compartment", a "freezing compartment" or a "variable temperature compartment" which are classified according to the purpose and/or temperature range. The refrigerating compartment may be maintained at a temperature suitable for storing food in a refrigerating manner, and the freezing compartment may be maintained at a temperature suitable for storing food in a freezing manner. "Refrigerating" may mean to cool food to the extent that it does not freeze, and as an example, the refrigerating compartment may be maintained in the range of 0 degrees Celsius to 7 degrees Celsius. "Freezing" may mean to freeze or cool food to remain frozen, and as an example, the freezing compartment may be maintained in the range of minus 20 degrees Celsius to minus 1 degree Celsius. The variable temperature compartment may be used as either the refrigerating compartment or the freezing compartment according to a user's choice or regardless of a user's choice. According to an embodiment, a portion of one storage compartment may be used as the refrigerating compartment and the remaining portion may be used as the freezing compartment.

The storage compartment may be called "vegetable compartment", "fresh compartment", "cooling compartment" and "ice making compartment" in addition to names such as "refrigerating compartment", "freezing compartment" and "variable temperature compartment". Terms such as "refrigerating compartment", "freezing compartment" and "variable temperature compartment" should be understood as encompassing storage compartments including corresponding uses and temperature ranges, respectively.

The refrigerator according to an embodiment may include a door configured to open and close one open side of the storage compartment.

The "door" may be configured to seal the storage compartment when the door is closed. In a similar manner as the main body, the door may include an insulating material to insulate the storage compartment when the door is closed.

The refrigerator according to an embodiment may include a cold air supply device configured to supply cold air to the storage compartment.

The "cold air supply device" may include a machine, an appliance, an electronic device, and/or a system corresponding to a combination thereof, which are capable of generating and guiding cold air so as to cool the storage compartment.

According to an embodiment, the cold air supply device may generate cold air through a refrigeration cycle including compression, condensation, expansion, and evaporation of a refrigerant. To this, the cold air supply device may include a refrigeration cycle device including a compressor, a condenser, an expansion device, and an evaporator capable of driving the refrigeration cycle. According to an embodiment, the cold air supply device may include a semiconductor such as a thermoelectric element. The thermoelectric element may cool the storage compartment by heating and cooling through the Peltier effect.

The refrigerator according to an embodiment may include a machine room in which at least some components belonging to the cold air supply device are disposed.

The "machine room" may be provided to be partitioned and insulated from the storage compartment in order to prevent heat, which is generated from components disposed in the machine room, from being transferred to the storage compartment. The inside of the machine room may be configured to communicate with the outside of the main body so as to dissipate heat from components disposed inside the machine room.

The refrigerator according to an embodiment may include a controller for controlling the refrigerator.

The "controller" may include a memory for storing or memorizing a program and/or data for controlling the refrigerator, and a processor for outputting a control signal for controlling the cold air supply device according to the program and/or data stored in the memory.

The memory may store programs and/or data for controlling components included in the refrigerator, and store temporary data that is generated while generating control signals for controlling components included in the refrigerator.

The processor may process a user input of the user interface according to a program and/or data memorized/stored in the memory, and may generate a control signal for controlling an operation of the user interface and/or the cold air supply device. For example, the processor may receive temperature information of the storage compartment from a temperature sensor and generate a cooling control signal for controlling the operation of the cold air supply device based on the temperature information of the storage compartment. The processor may receive a user input from the user interface, and transmit a display control signal and image data, which is for displaying an image on the user interface, to the user interface in response to the user input.

The controller may include the processor and the memory configured to control all components included in the refrigerator, and may further include a plurality of processors and a plurality of memories configured to individually control components of the refrigerator. For example, the controller may separately include a processor and a memory configured to control the operation of the cold air supply device according to the output of the temperature sensor, and a processor and a memory configured to control the operation of the user interface according to the user input. The processor and the memory may be provided integrally or separately. The processor may include a plurality of processors, and the memory may include a plurality of memories.

Reference will now be made in detail to embodiments of the disclosure, examples of which are illustrated in the accompanying drawings.

Figure 2:
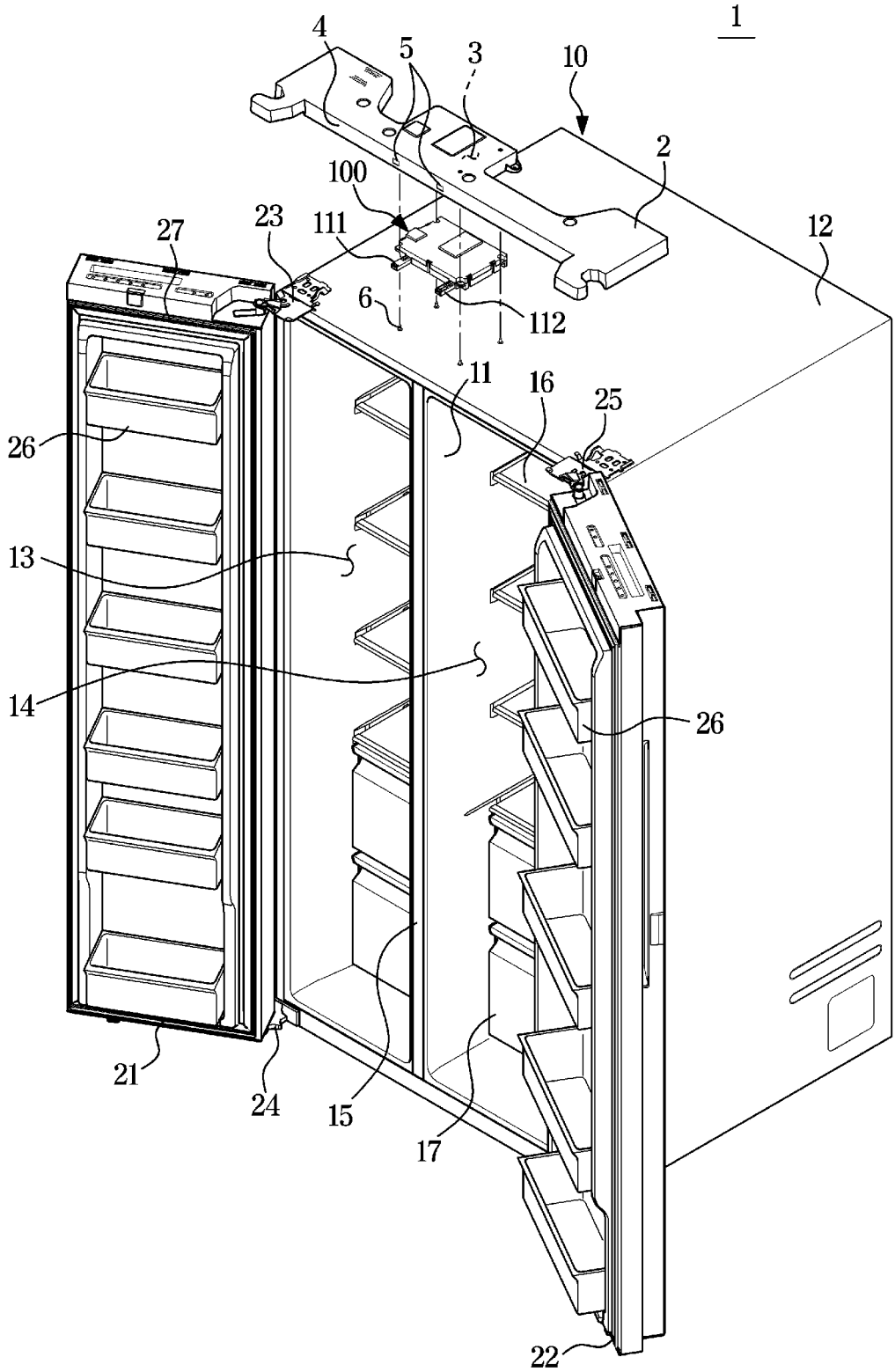
FIG. 2 is a view illustrating a state in which a door of the refrigerator is opened and a door opening device is separated according to an embodiment of the disclosure.
Figure 3:
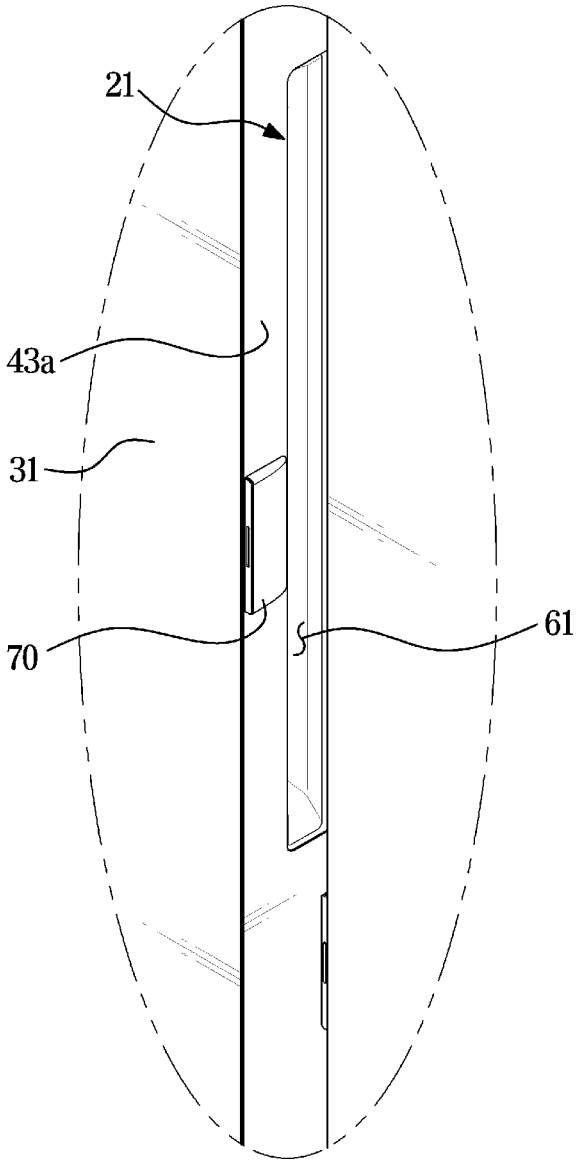
FIG. 3 is an enlarged view of a dotted line portion of FIG. 1, particularly, an enlarged view of a handle of a first door and a switch module of the first door according to an embodiment of the disclosure.
Figure 4:
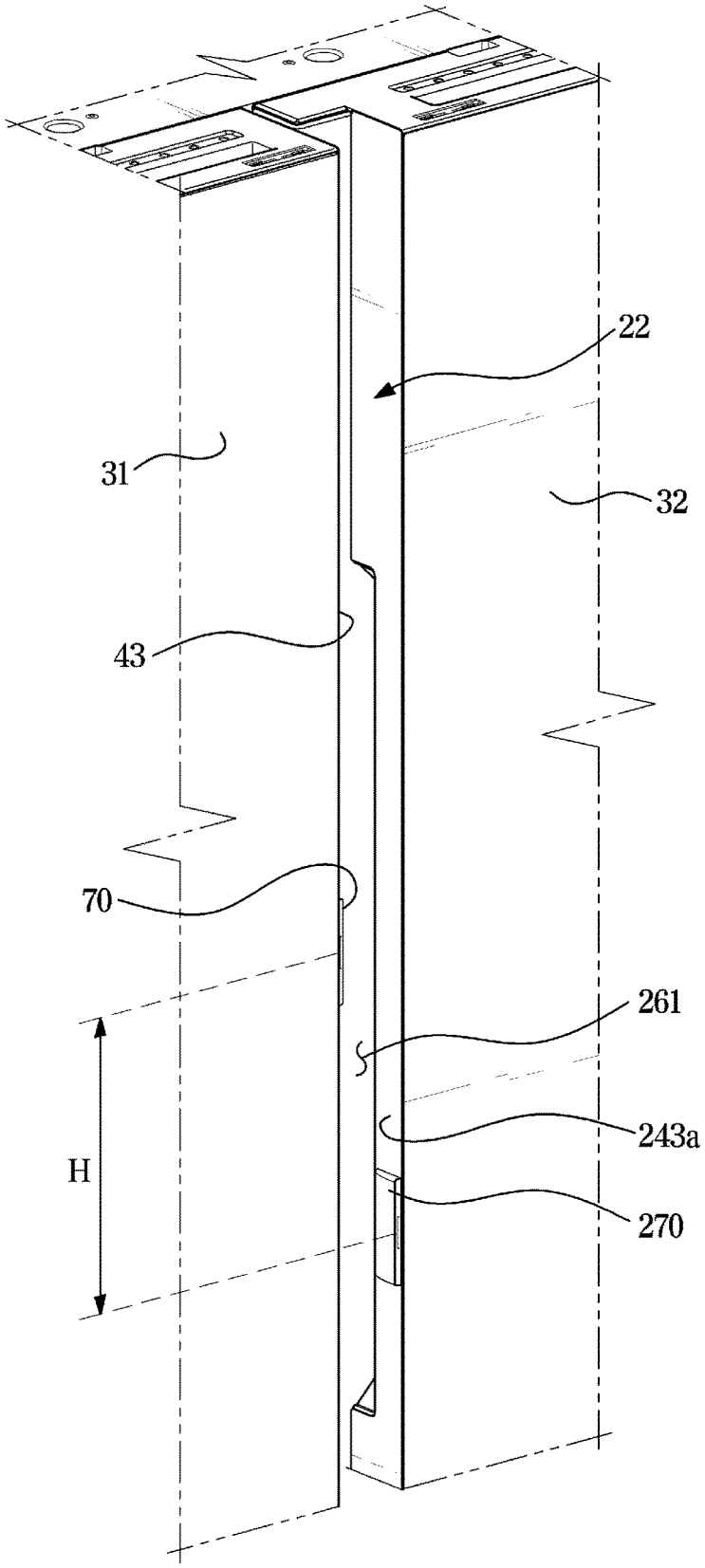
FIG. 4 is a view illustrating a comparison between the switch module of the first door and a switch module of a second door according to an embodiment of the disclosure.

FIG. 1 is a view illustrating an appearance of a refrigerator according to an embodiment of the disclosure. FIG. 2 is a view illustrating a state in which a door of the refrigerator is opened and a door opening device is separated according to an embodiment of the disclosure. FIG. 3 is an enlarged view of a dotted line portion of FIG. 1, particularly, an enlarged view of a handle of a first door and a switch module of the first door according to an embodiment of the disclosure. FIG. 4 is a view illustrating a comparison between the switch module of the first door and a switch module of a second door according to an embodiment of the disclosure.

Referring to FIGS. 1 to 4, the refrigerator 1 according to an embodiment may include a main body 10, storage compartments 13 and 14 formed inside the main body 10, doors 21 and 22 configured to close and open the storage compartments 13 and 14, and a cold air supply device configured to supply cold air to the storage compartments 13 and 14.

The main body 10 may include an inner case 11 forming the storage compartments 13 and 14, an outer case 12 coupled to the outside of the inner case 11 to form an exterior, and an insulating material provided between the inner case 11 and the outer case 12 to insulate the storage compartments 13 and 14.

The storage compartments 13 and 14 may be partitioned into a storage compartment 13 on the left side and a storage compartment 14 on the right side by a vertical partition wall 15. The storage compartment 13 on the left side may be used as a freezing compartment, and the storage compartment 14 on the right side may be used as a refrigerating compartment. However, the division and use of the storage compartments 13 and 14 as described above is only an example, and is not limited thereto.

A shelf 16 on which an item is placed and a storage container 17 for storing an item may be provided in the storage compartments 13 and 14.

The cold air supply device may generate cold air using a refrigeration circulation cycle of compressing, condensing, expanding, and evaporating a refrigerant, and supply the generated cold air to the storage compartments 13 and 14.

The refrigerator 1 according to an embodiment may include the doors 21 and 22 configured to open and close the storage compartments 13 and 14. A door 21 on the left may open and close the storage compartment 13 on the left side, and a door 22 on the right may open and close the storage compartment 14 on the right side.

The doors 21 and 22 may be rotatably coupled to the main body 10. Hinges 23, 24, and 25 may be provided in the main body 10 to rotatably couple the doors 21 and 22 to the main body 10.

On a rear surface of the doors 21 and 22, a door shelf 26 to store food and a gasket 27 that can be closely adhered to the front surface of the main body 10 so that the storage compartments 13 and 14 are sealed when the doors are closed may be provided. Front panels 31 and 32 may be coupled to front surfaces of the doors 21 and 22. The front panels 31 and 32 may be detachably coupled to the front surfaces of the doors 21 and 22.

A top table 2 may be provided on an upper surface of the main body 10. The top table 2 may cover at least a portion of the upper hinges 23 and 25 and prevent the upper hinges 23 and 25 from being exposed to the outside.

A door opening device 100 configured to open the doors 21 and 22 may be provided inside the top table 2. A door opening device receiving member 3, in which the door opening device 100 is received, may be formed on a bottom surface of the top table 2, and the door opening device 100 may be received in the door opening device receiving member 3. The door opening device 100 may be coupled to the bottom surface of the top table 2 to be received in the door opening device receiving member 3. The door opening device 100 may be coupled to the bottom surface of the top table 2 through a fastening member 6. The top table 2 may be coupled to the upper surface of the main body 10 in a state in which the door opening device 100 is coupled to the top table 2.

The door opening device 100 may open the doors 21 and 22 by pushing the rear surfaces of the doors 21 and 22 forward. The door opening device 100 may partially open the doors 21 and 22 to allow a user to open the doors 21 and 22 with little force. The door opening device 100 may include push rods 111 and 112 configured to move. The push rods 111 and 112 may include a first push rod 111 configured to open the first door 21 and a second push rod 112 configured to open the second door 22.

Rod holes 5 through which the first push rod 111 and the second push rod 112 penetrate may be formed in a front surface 4 of the top table 2.

A first handle 61 that is recessed to allow a user to put his/her hand and to be gripped by the user may be formed on a side surface 43*a* of the first door 21. The first handle 61 may be recessed on the side surface 43*a* of the first door 21, but may be formed only in a part of a section between an upper end and a lower end of the first door 21 rather than in the entire section. Therefore, a space, which may be occupied by the handle, may be used as a space inside the door, and the space inside the door may be increased.

A second handle 261 that is recessed to allow a user to put his/her hand and to be gripped by the user may be formed on a side surface 243*a* of the second door 22. The second handle 261 may be recessed on the side surface 243*a* of the second door 22, but may be formed only in a part of a section between an upper end and a lower end of the second door 22 rather than in the entire section. Therefore, a space, which may be occupied by the handle, may be used as a space inside the door, and the space inside the door may be increased.

Figure 6:
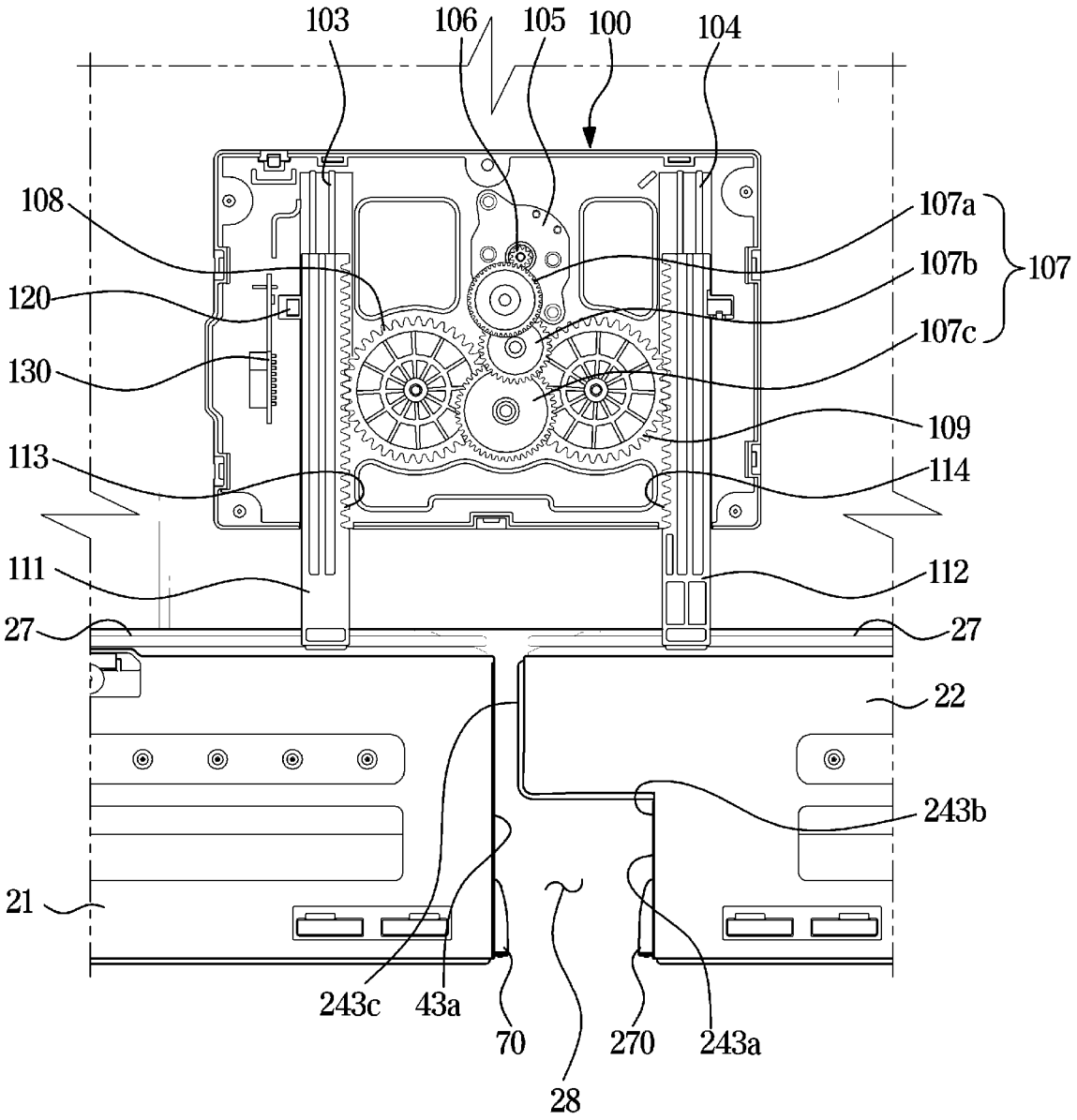
FIG. 6 is a view of a neutral position of the door opening device according to an embodiment of the disclosure.

The side surface 243*a* of the second door 22 may be formed to have a step (refer to FIG. 6). That is, a distance between a front portion 243*b* of the side surface 243*a* of the second door 22 and the side surface 43*a* of the first door 21 may be greater than a distance between a rear portion 243*c* of the side surface 243*a* of the second door 22 and the side surface 43*a* of the first door 21. Therefore, between the front portion 243*b* of the side surface 243*a* of the second door 22 and the side surface 43*a* of the first door 21, a space 28 through which a user can put his/her hand to the first handle 61 and the second handle 261 may be formed.

The second handle 261 may be formed on the front portion 243*b* of the side surface 243*a* of the second door 22.

The door opening device 100 may be operated by switch modules 70 and 270. A user can operate the door opening device 100 by manipulating the switch modules 70 and 270. According to an embodiment, the switch modules 70 and 270 may be operated by a user's touch.

The switch modules 70 and 270 may include a first switch module 70 provided on the first door 21 and a second switch module 270 provided on the second door 22. The first switch module 70 may operate the door opening device 100 to allow the door opening device 100 to open the first door 21. The second switch module 270 may operate the door opening device 100 to allow the door opening device 100 to open the second door 22.

That is, the first switch module 70 may operate the door opening device 100 to allow the first push rod 111 to move forward and the second push rod 112 to move backward. The first push rod 111 may advance and press the first door 21 to open the first door 21. The second switch module 270 may operate the door opening device 100 to allow the first push rod 111 to move backward and the second push rod 112 to move forward.

The first switch module 70 may be provided on the side surface 43*a* of the first door 21. The first switch module 70 may be located in front of the first handle 61 on the side surface 43*a* of the first door 21. Accordingly, the first switch module 70 may be touched at the same time as a user holds the first handle 61 with his/her hand.

At least a portion of the first switch module 70 may be provided to protrude from the side surface 43*a* of the first door 21. Due to this structure, a user can hold the first handle 61 more comfortably.

The second switch module 270 may be provided on the side surface 243*a* of the second door 22. The second switch module 270 may be located in front of the second handle 261 on the side surface 243*a* of the second door 22. Accordingly, the second switch module 270 may be touched at the same time as a user holds the second handle 261 with his/her hand.

At least a portion of the second switch module 270 may be provided to protrude from the side surface 243*a* of the second door 22. Due to this structure, a user can hold the second handle 261 more comfortably.

According to an embodiment of the disclosure, heights of the first switch module 70 and the second switch module 270 may be different from each other. That is, the height of the first switch module 70 and the height of the second switch module 270 may differ by a predetermined height H.

Because the height of the first switch module 70 and the height of the second switch module 270 are different, it is possible to prevent one of the first switch module 70 and the second switch module 270 from being unintentionally touched, and it is possible to prevent the malfunction of the door opening device 100.

Figure 5:
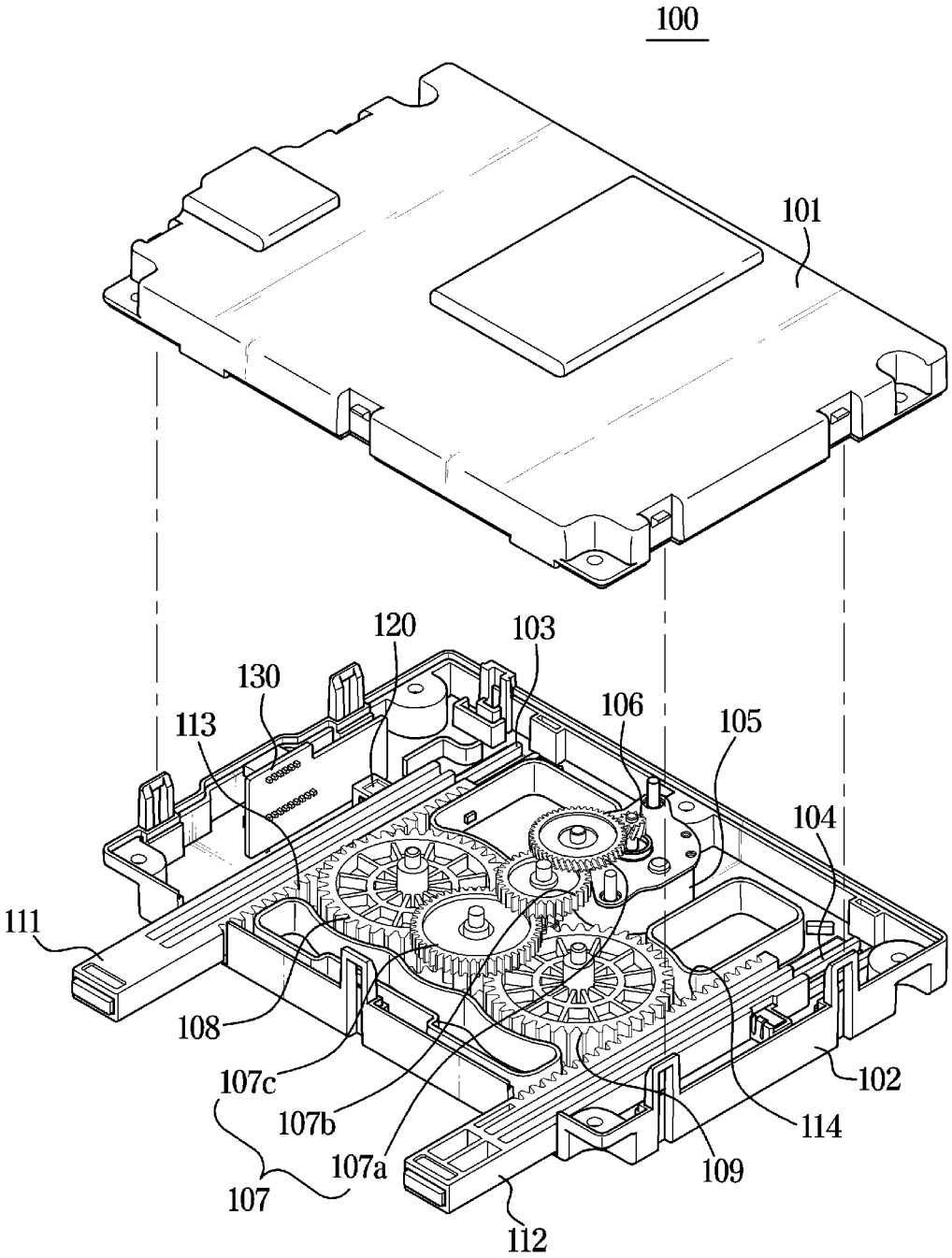
FIG. 5 is an exploded view of the door opening device according to an embodiment of the disclosure.
Figure 7:
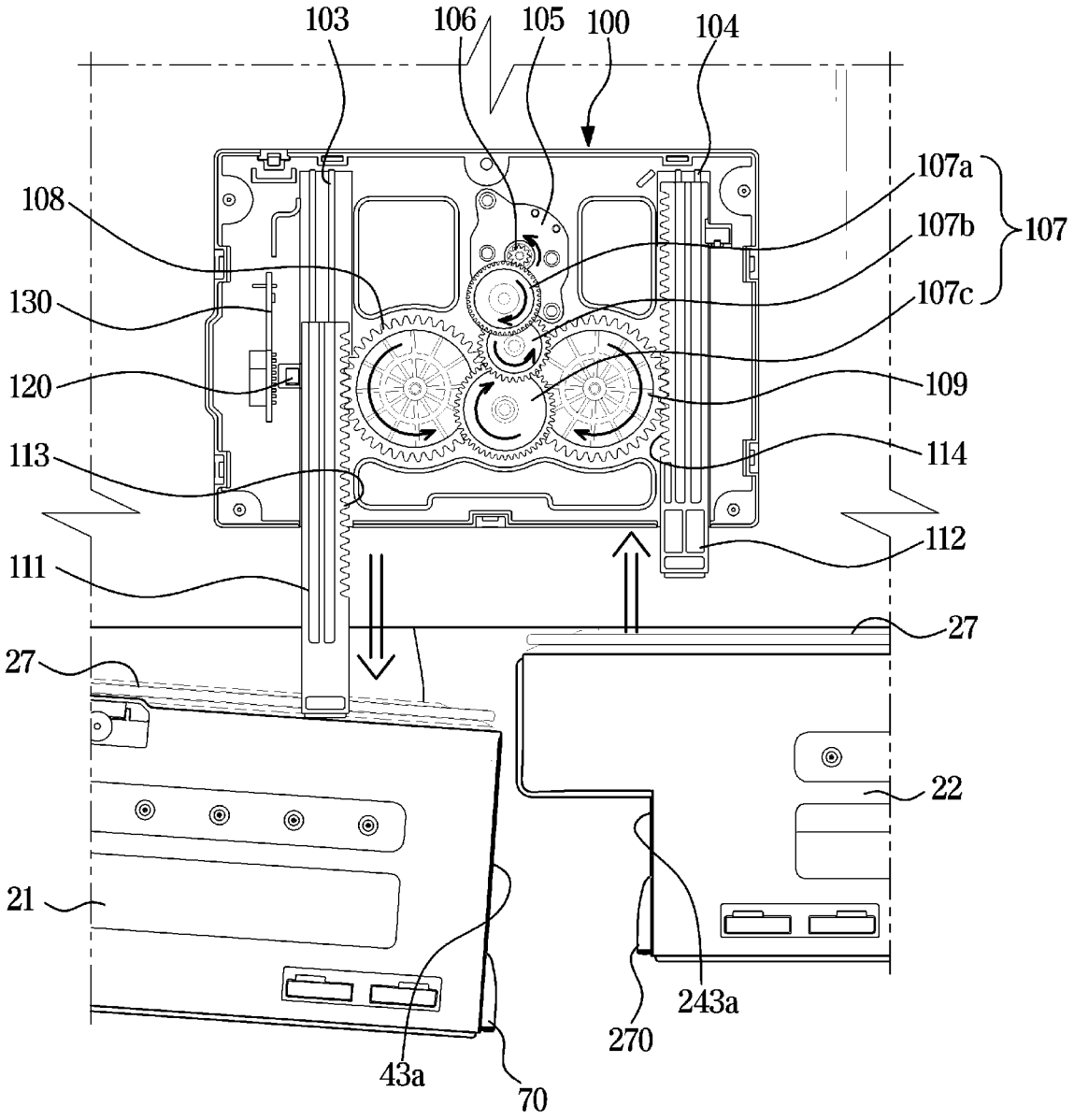
FIG. 7 is a view illustrating a state in which a first push rod of the door opening device is at a maximum forward position and a second push rod of the door opening device is at a maximum backward position according to an embodiment of the disclosure.
Figure 8:
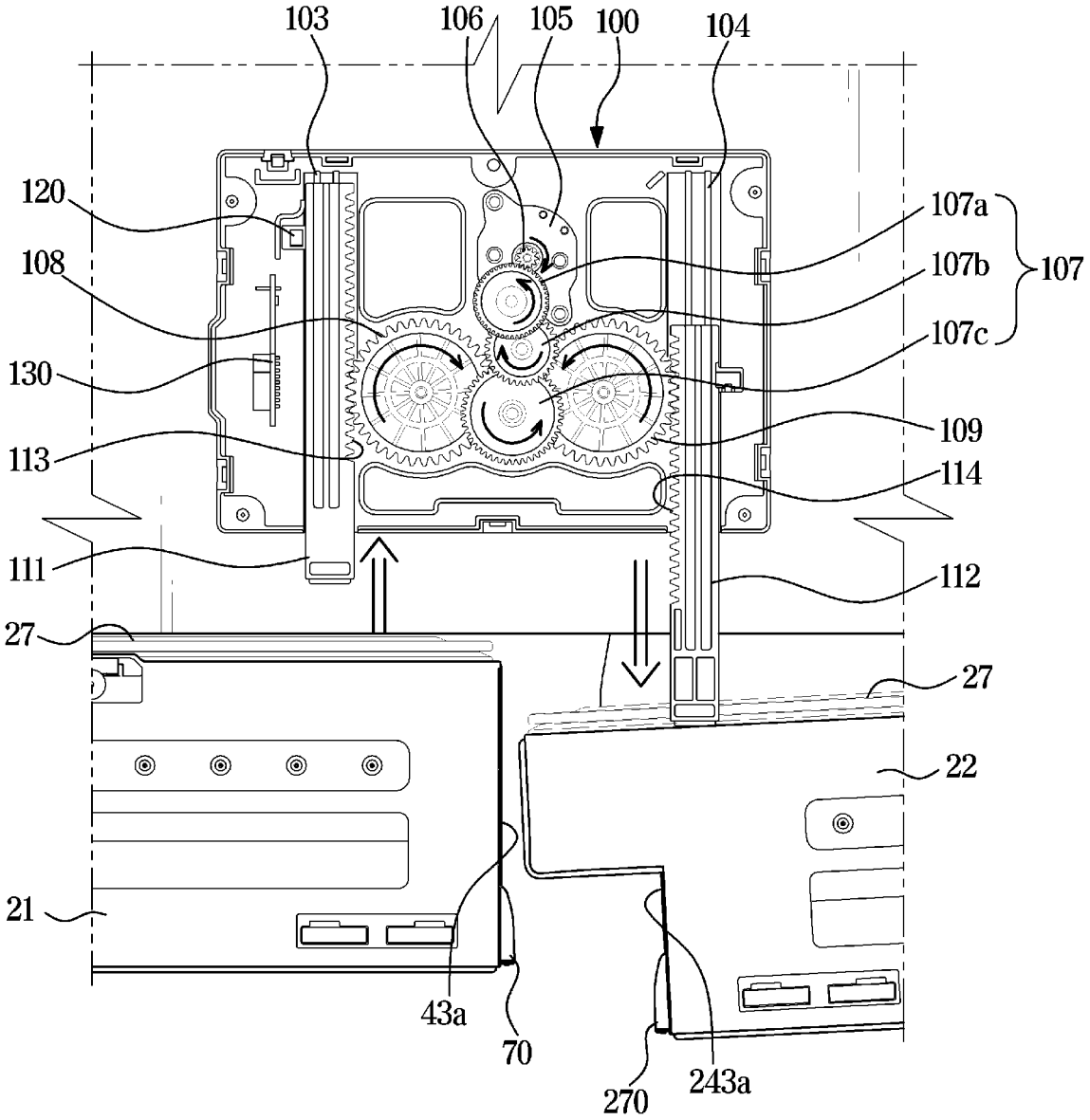
FIG. 8 is a view illustrating a state in which the first push rod of the door opening device is at a maximum backward position and the second push rod of the door opening device is at a maximum forward position according to an embodiment of the disclosure.
Figure 9:
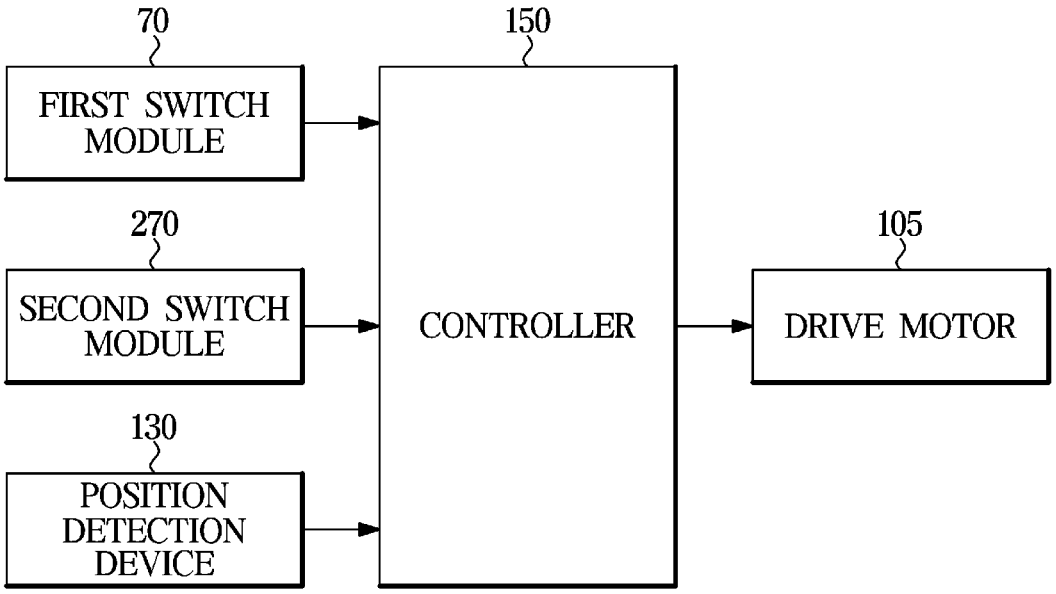
FIG. 9 is a control block diagram of the refrigerator according to an embodiment of the disclosure.

FIG. 5 is an exploded view of the door opening device according to an embodiment of the disclosure. FIG. 6 is a view of a neutral position of the door opening device according to an embodiment of the disclosure. FIG. 7 is a view illustrating a state in which a first push rod of the door opening device is at a maximum forward position and a second push rod of the door opening device is at a maximum backward position according to an embodiment of the disclosure. FIG. 8 is a view illustrating a state in which the first push rod of the door opening device is at a maximum backward position and the second push rod of the door opening device is at a maximum forward position according to an embodiment of the disclosure. FIG. 9 is a control block diagram of the refrigerator according to an embodiment of the disclosure.

Referring to FIGS. 5 to 9, according to an embodiment of the disclosure, the door opening device 100 may include cases 101 and 102, a drive motor 105 provided inside the cases 101 and 102, the pair of push rods 111 and 112 configured to move forward and backward by the driving force generated in the drive motor 105, and a transmission gear assembly 107 configured to transmit the driving force of the drive motor 105 to the pair of push rods 111 and 112.

The cases 101 and 102 may include an upper case 101 and a lower case 102 coupled to a lower portion of the upper case 101. The drive motor 105 and the transmission gear assembly 107 may be received inside the cases 101 and 102. A portion of the push rods 111 and 112 may pass through the cases 101 and 102 and protrude out of the cases 101 and 102.

The pair of push rods 111 and 112 may be configured to move forward and backward, respectively. The pair of push rods 111 and 112 may be configured to move in opposite directions at the same time. The pair of push rods 111 and 112 may be configured to move at the same speed in opposite directions.

A pair of movement guides 103 and 104 provided to guide movement of the pair of push rods 111 and 112 may be arranged inside the cases 101 and 102. The pair of push rods 111 and 112 may be movably coupled to the pair of movement guides 103 and 104, respectively, and may move forward and backward along with the movement guides 103 and 104. The pair of movement guides 103 and 104 may be arranged parallel to each other.

The drive motor 105 may be a motor capable of forward and reverse driving. The drive motor 105 may include a DC stepper motor. A motor gear 106 may be provided on a motor shaft of the drive motor 105 to rotate together with the motor shaft. A rotational force of the motor gear 106 may be transmitted to a pair of pinion gears 108 and 109 through the transmission gear assembly 107.

Rack gears 113 and 114 engaged with the pinion gears 108 and 109 may be provided on the push rods 111 and 112. A rotational motion of the pinion gears 108 and 109 may be converted into a linear motion of the rack gears 113 and 114.

A first rack gear 113 may be engaged with the first pinion gear 108 to allow the first push rod 111 to move forward when the first pinion gear 108 rotates counterclockwise, and to allow the first push rod 111 to move backward when the first pinion gear 108 rotates clockwise.

A second rack gear 114 may be engaged with the second pinion gear 109 to allow the second push rod 112 to move backward when the second pinion gear 109 rotates counterclockwise, and to allow the second push rod 112 to move forward when the second pinion gear 109 rotates clockwise.

The transmission gear assembly 107 may include at least one transmission gear 107*a*, 107*b*, and 107*c*. The number of transmission gears included in the transmission gear assembly 107 is not limited thereto. The transmission gears 107*a*, 107*b*, and 107*c* may have the form of two-stage spur gear to reduce the rotational force of the drive motor 105 and transmit the reduced rotation force to the pair of pinion gears 108 and 109. That is, the transmission gears 107*a*, 107*b*, and 107*c* may include an upper spur gear and a lower spur gear having a radius smaller than that of the upper spur gear.

The motor gear 106 may be engaged with an upper spur gear of the first transmission gear 107*a*. A lower spur gear of the first transmission gear 107*a* may be engaged with an upper spur gear of the second transmission gear 107*b*. A lower spur gear of the second transmission gear 107*b* may be engaged with an upper spur gear of the third transmission gear 107*c*. A lower spur gear of the third transmission gear 107*c* may be engaged with the first pinion gear 108 and the second pinion gear 109. The first pinion gear 108 may be engaged with the first rack gear 113 and the second pinion gear 109 may be engaged with the second rack gear 114.

The door opening device 100 may include a position detection device 130 configured to detect a position of the push rods 111 and 112. The position detection device 130 may include a Hall sensor configured to detect a change in a magnetic field and generate a voltage. A magnet 120 provided to be detected by the position detection device 130 may be provided in one of the plurality of push rods 111 and 112.

However, the position detection device 130 is not limited thereto, and may include various types of sensors such as an optical sensor and a proximity sensor.

As described above, the first push rod 111 and the second push rod 112 may move at the same speed in opposite directions, and thus when a position of one of the first push rod 111 and the second push rod 112 is detected, a position of the other of the first push rod 111 and the second push rod 112 may be detected. Accordingly, it may be sufficient that the position detection device 130 and the magnet 120 are configured to detect the position of one of the plurality of push rods 111 and 112.

The door opening device 100 may open the first door 21 or the second door 22 according to the driving direction of the drive motor 105. For example, when the drive motor 105 rotates in a forward direction (e.g., counterclockwise when viewed from above), the first push rod 111 of the door opening device 100 may move forward to open the first door 21. When the drive motor 105 rotates in a reverse direction (e.g., clockwise when viewed from above), the second push rod 112 of the door opening device 100 may move forward to open the second door 22.

The driving direction of the drive motor 105 may be determined according to manipulation of the switch modules 70 and 270. For example, when the first switch module 70 is operated, the drive motor 105 may be driven in the forward direction to allow the first door 21 to be opened. When the second switch module 270 is operated, the drive motor 105 may be driven in the reverse direction to allow the second door 22 to be opened.

According to an embodiment, the refrigerator 1 may include a controller 150 configured to control the driving of the drive motor 105 according to a user input received by the switch modules 70 and 270 and the position information of the push rods 111 and 112 detected by the position detection device 130.

In response to a user input being received by the first switch module 70, the first switch module 70 may transmit an opening signal of the first door 21 to the controller 150, and the controller 150 may control the drive motor 105 to rotate in one direction.

In response to a user input being received by the second switch module 270, the second switch module 270 may transmit an opening signal of the second door 22 to the controller 150, and the controller 150 may control the drive motor 105 to rotate in the other direction.

The controller 150 may control the drive motor 105 to stop according to the positions of the push rods 111 and 112 detected by the position detection device 130.

The controller 150 may control the drive motor 105 to stop through a door opening and closing sensor configured to detect opening and closing of the doors 21 and 22.

Figure 10:
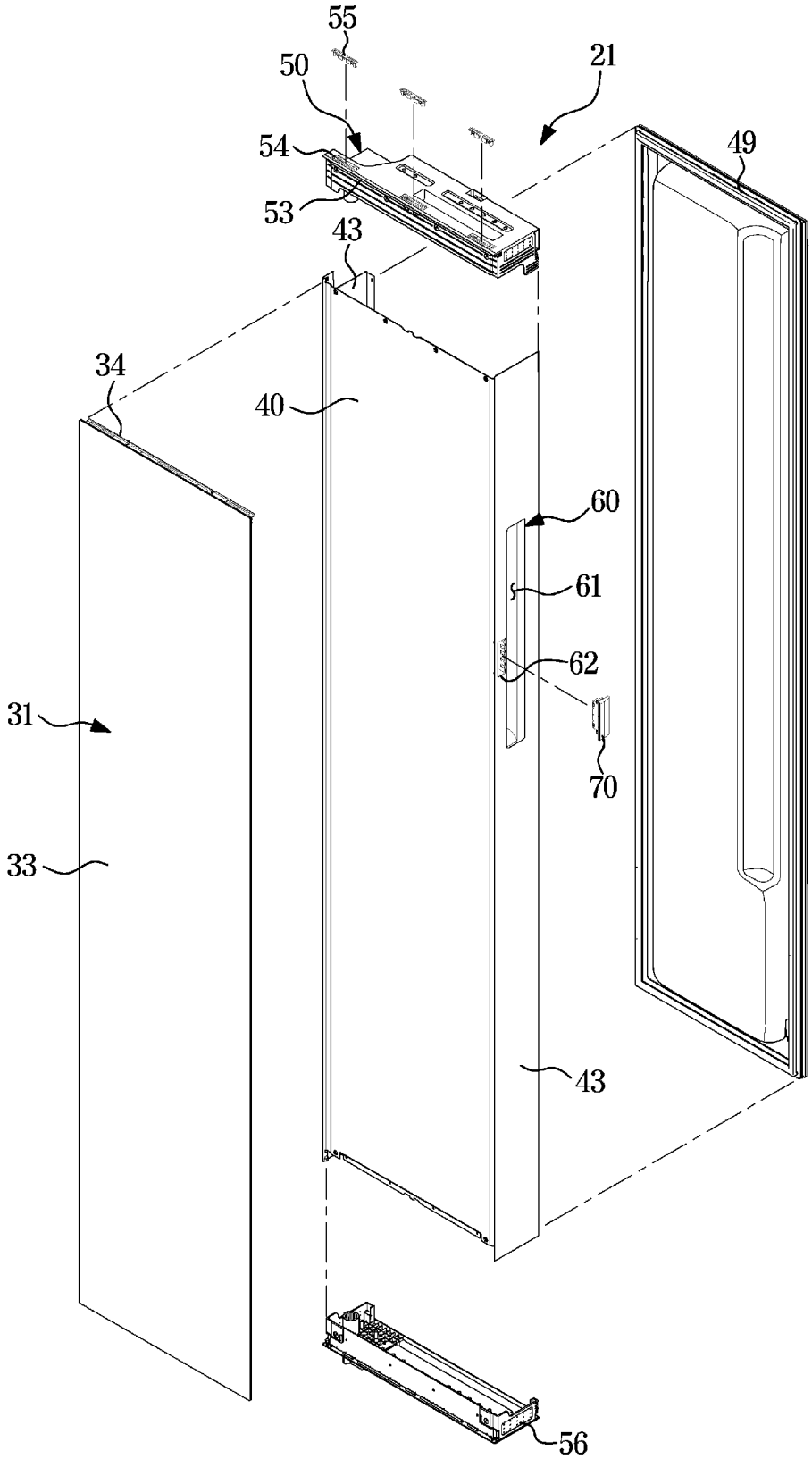
FIG. 10 is a view illustrating a state in which the door and a front panel are separated according to an embodiment of the disclosure.
Figure 11:
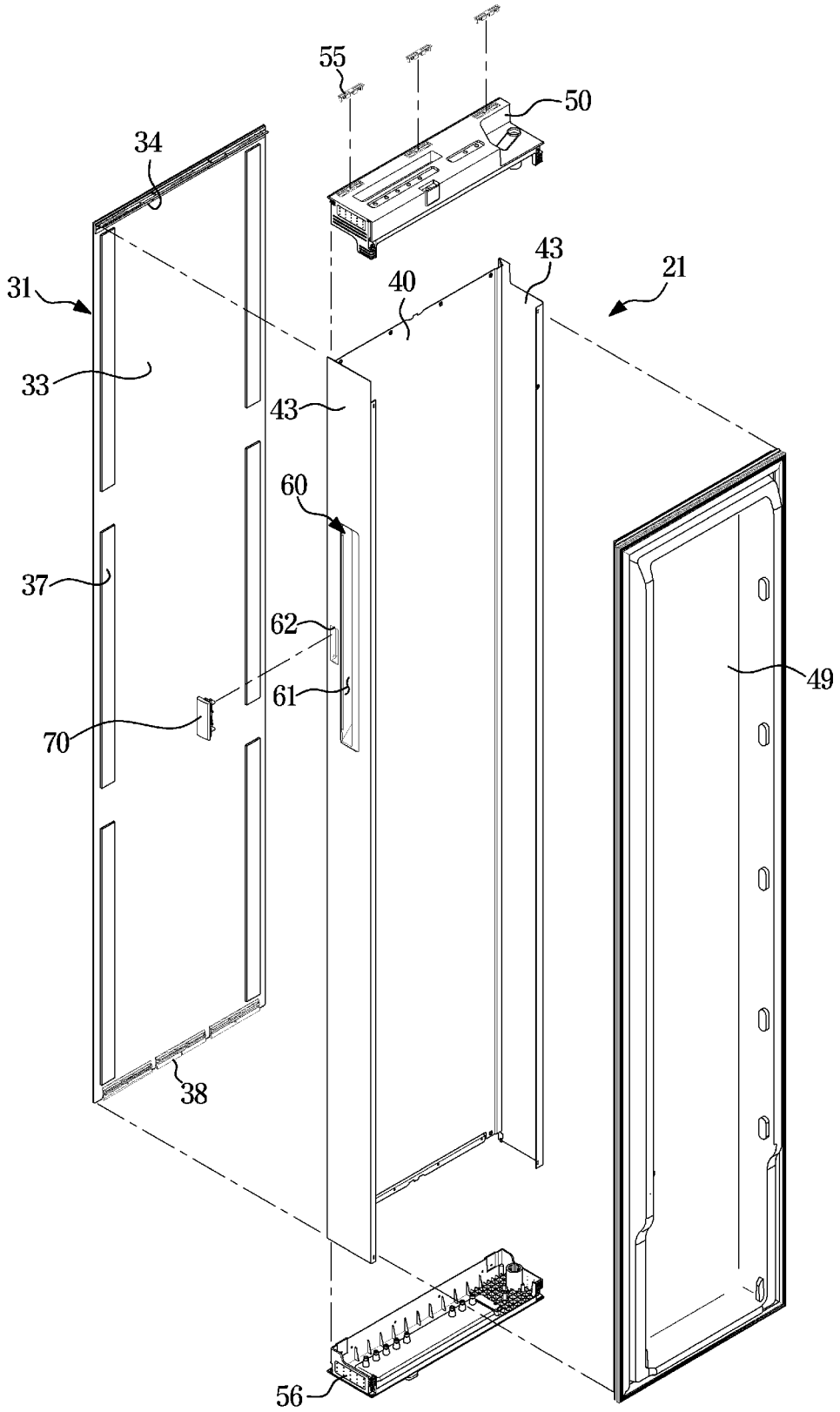
FIG. 11 is a view illustrating a state in which the door and the front panel are separated according to an embodiment of the disclosure when viewed from another angle.
Figure 12:
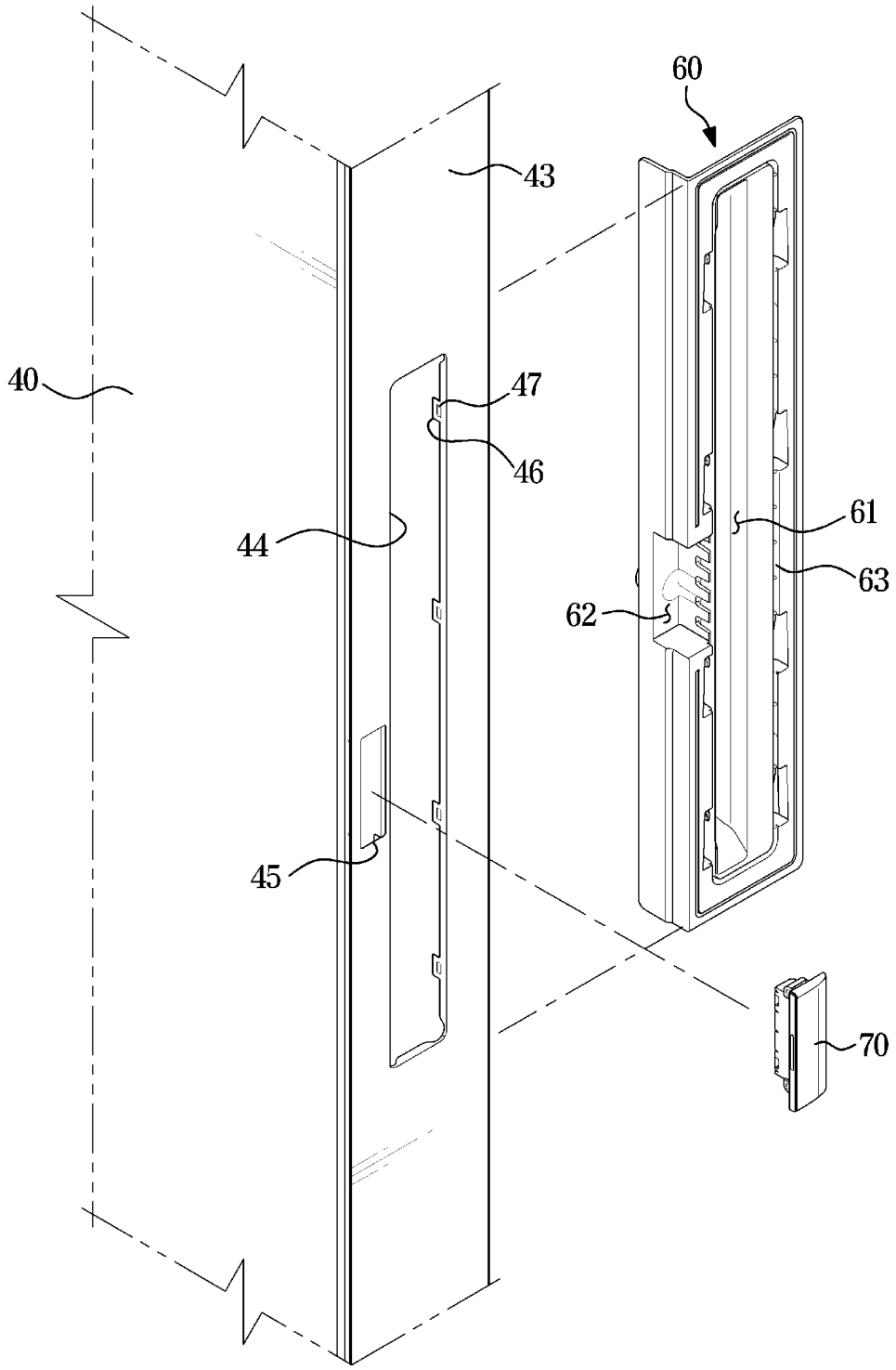
FIG. 12 is a view illustrating a side member and a side cap of the door according to an embodiment of the disclosure.
Figure 13:
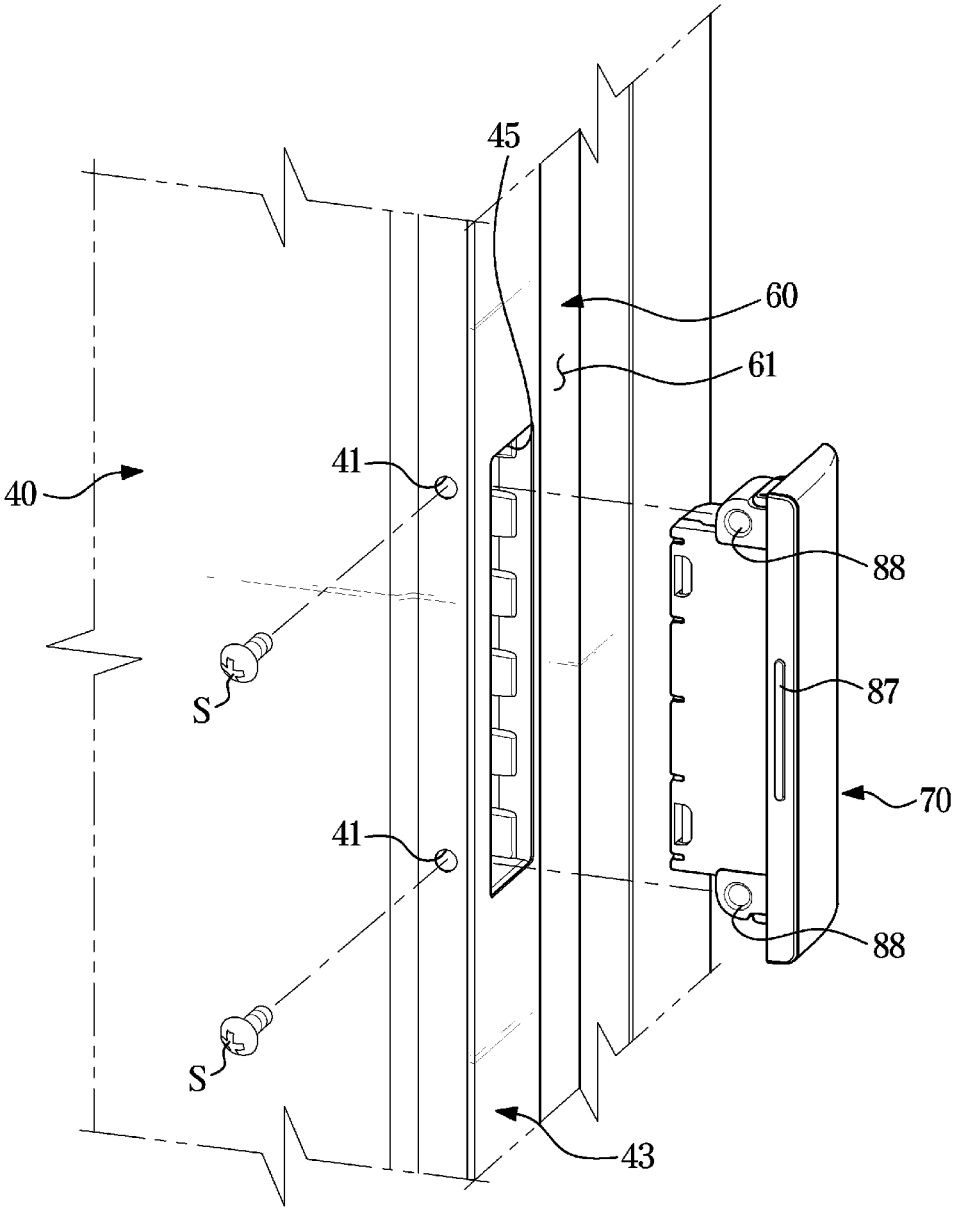
FIG. 13 is a view illustrating a state in which the side cap of the door and a switch module are separated according to an embodiment of the disclosure.
Figure 14:
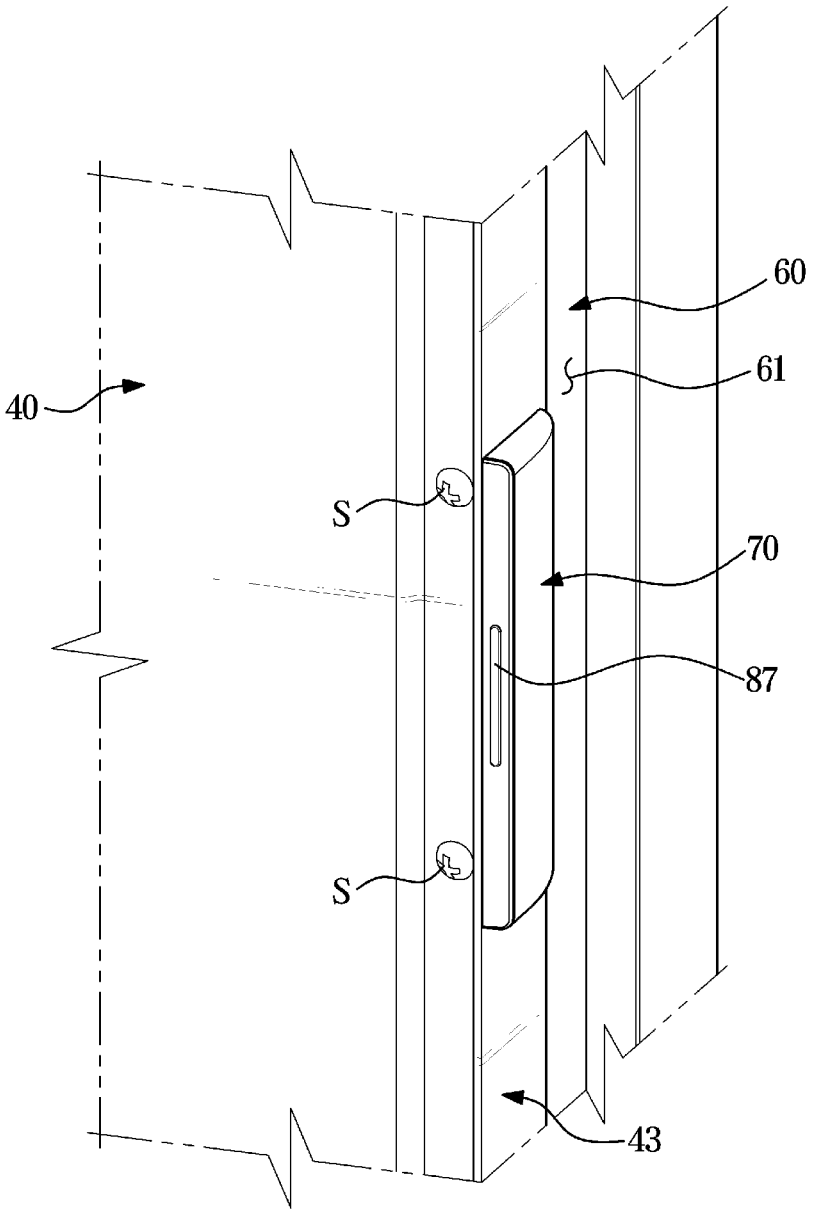
FIG. 14 is a view illustrating a state in which the switch module is mounted on the side cap of the door according to an embodiment of the disclosure.
Figure 15:
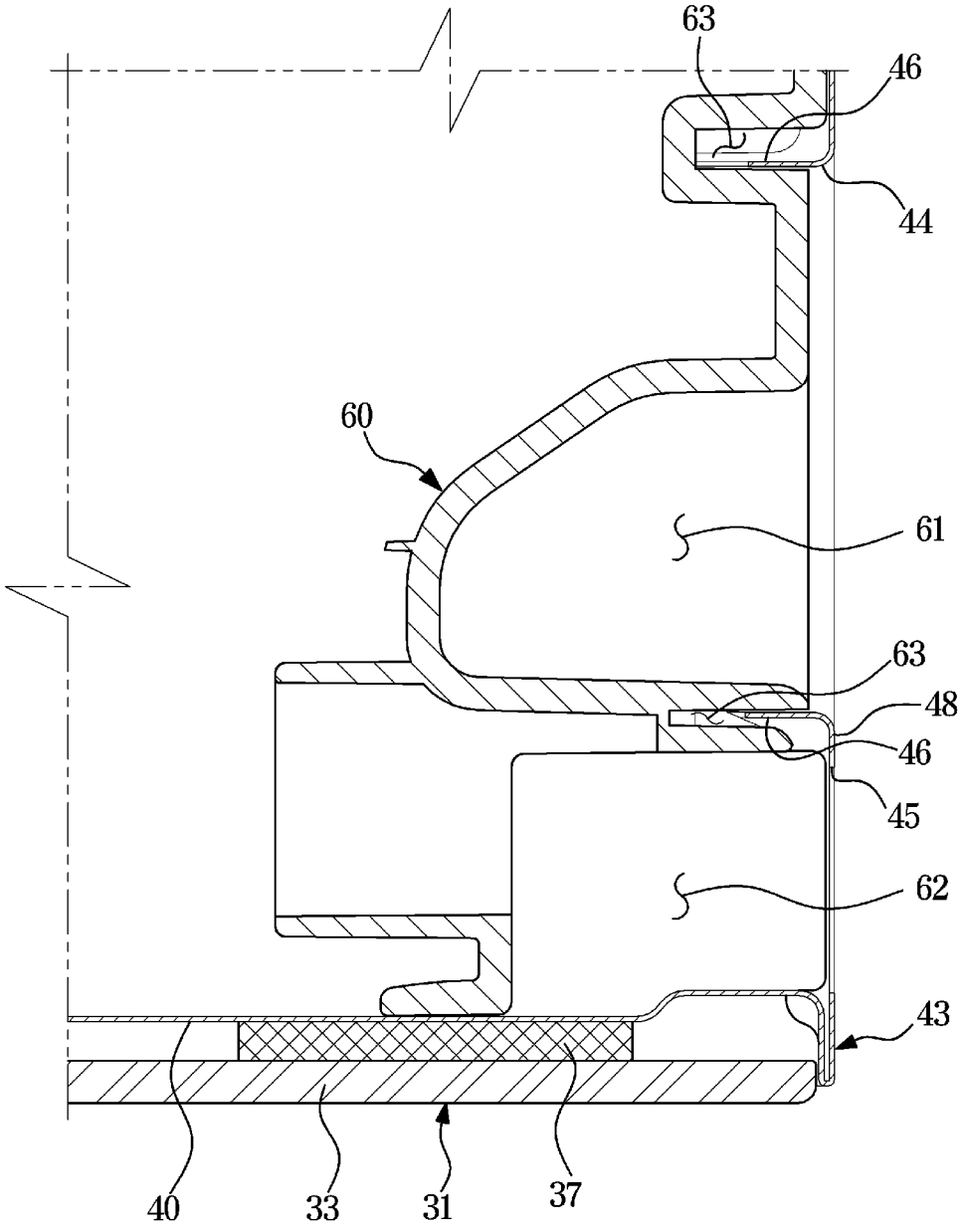
FIG. 15 is a cross-sectional view of a portion of the door according to an embodiment of the disclosure, particularly, a view illustrating a state in which the switch module is removed.
Figure 16:
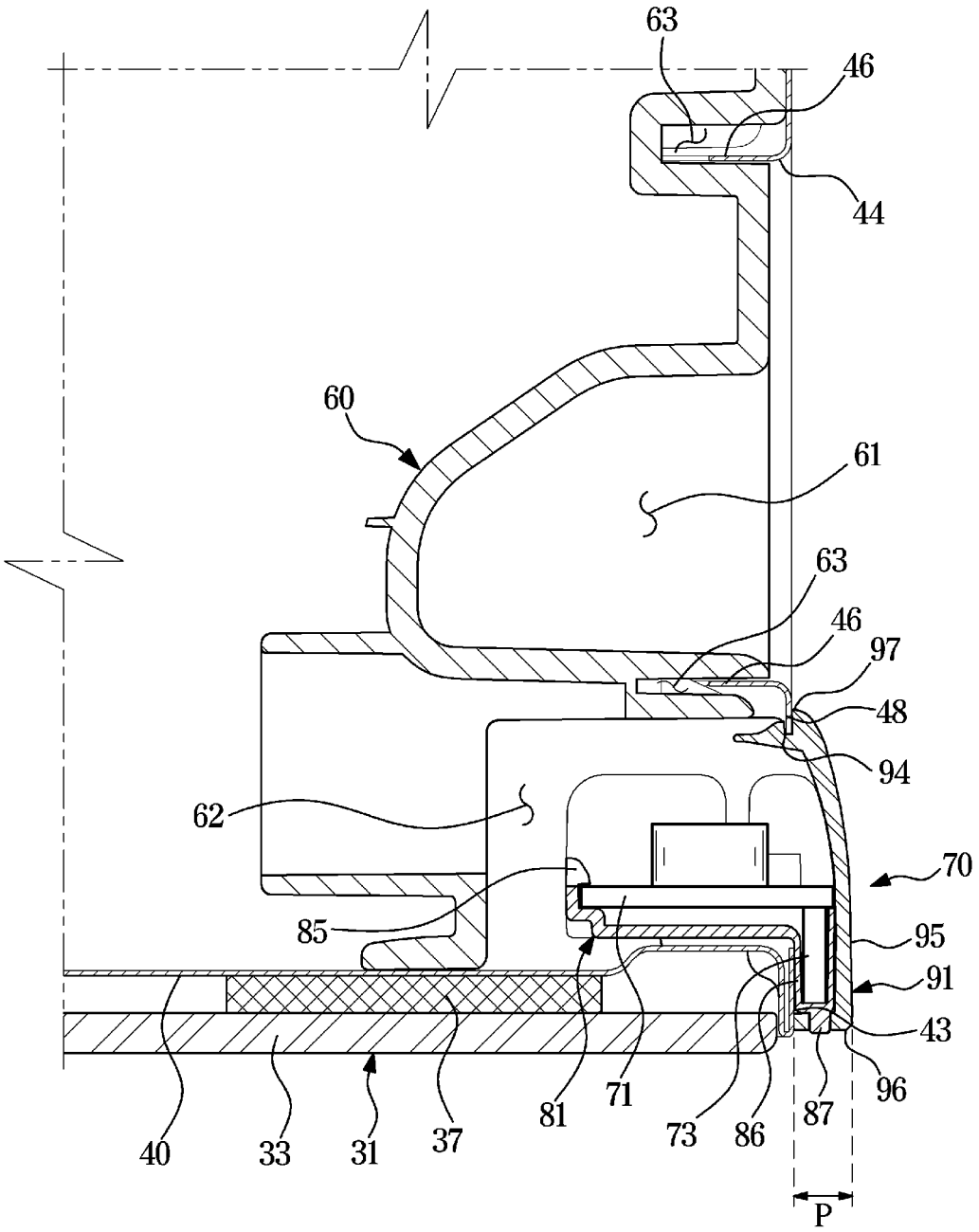
FIG. 16 is a cross-sectional view of a portion of the door according to an embodiment of the disclosure, particularly, a view illustrating a state in which the switch module is included.
Figure 17:
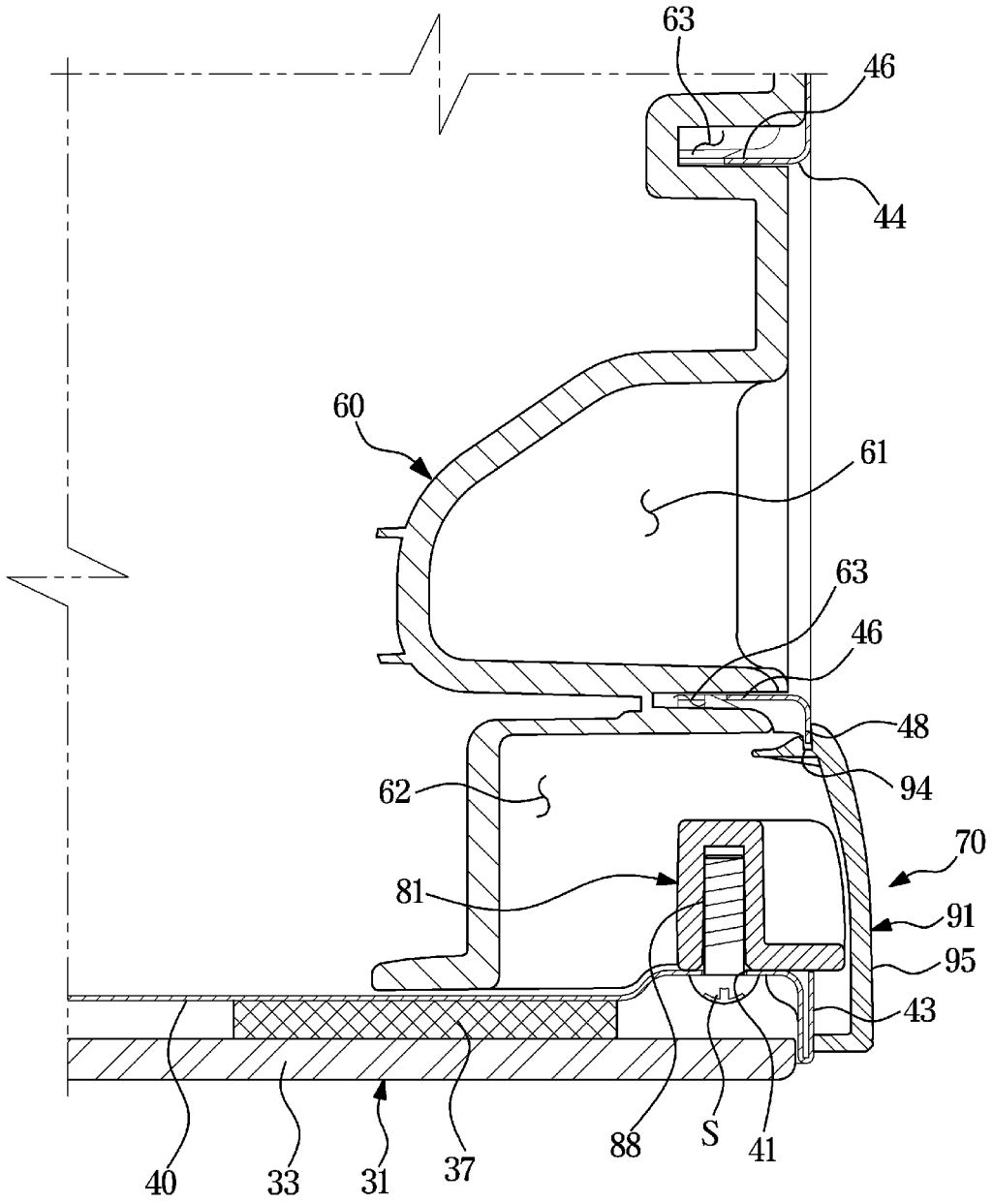
FIG. 17 is a cross-sectional view of a portion of the door according to an embodiment of the disclosure, particularly, a view illustrating a coupling structure between the switch module and a door front member.
Figure 18:
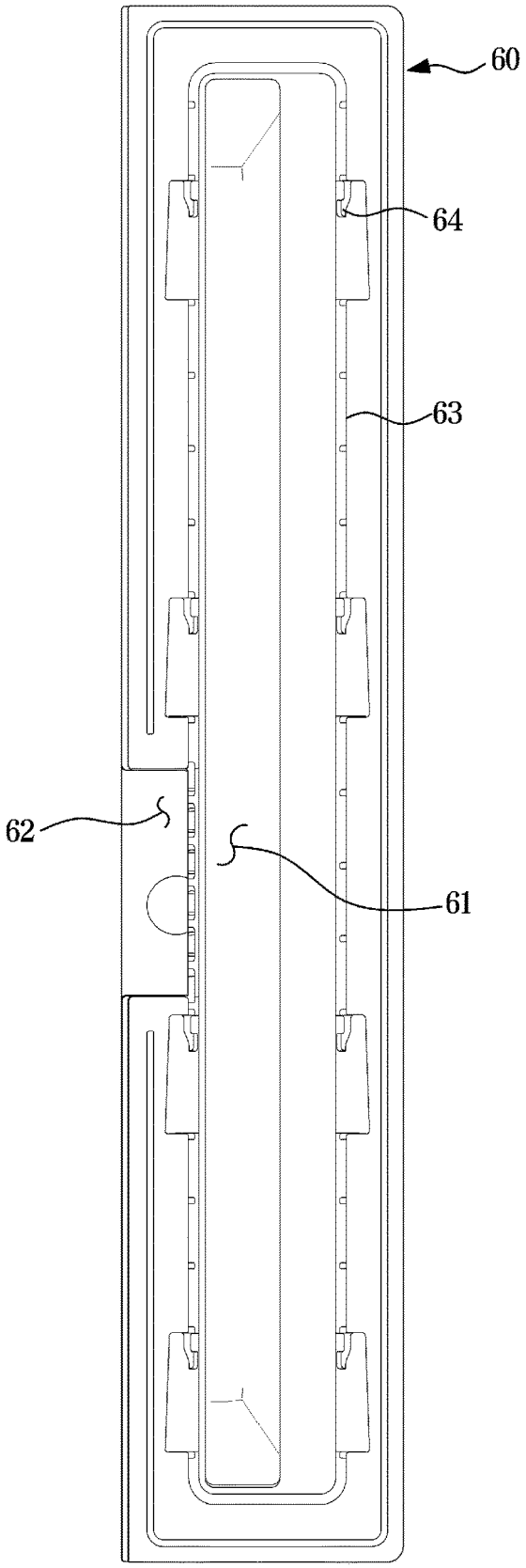
FIG. 18 is a view illustrating the side cap according to an embodiment of the disclosure.
Figure 19:
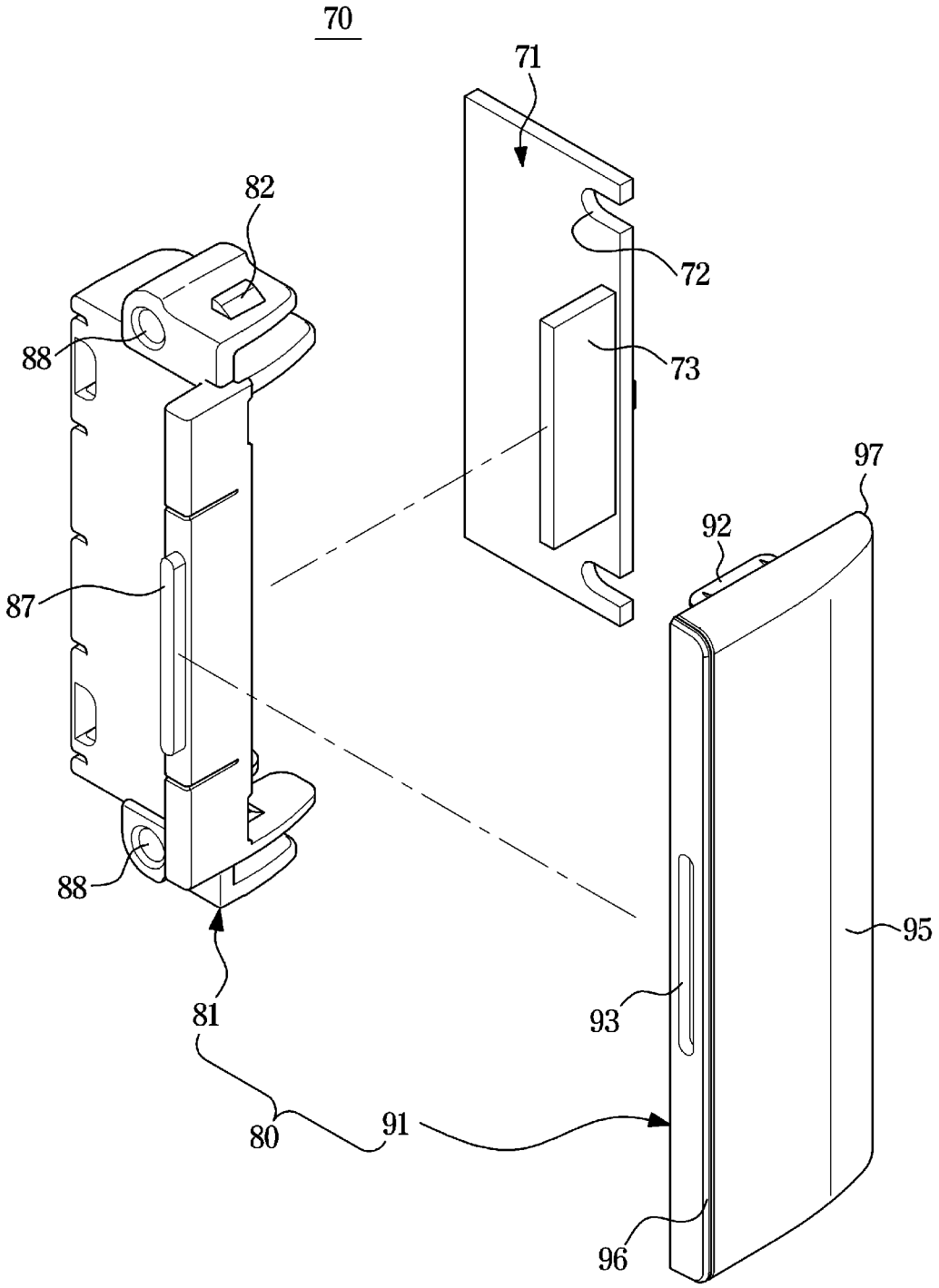
FIG. 19 is an exploded view illustrating the switch module according to an embodiment of the disclosure.
Figure 20:
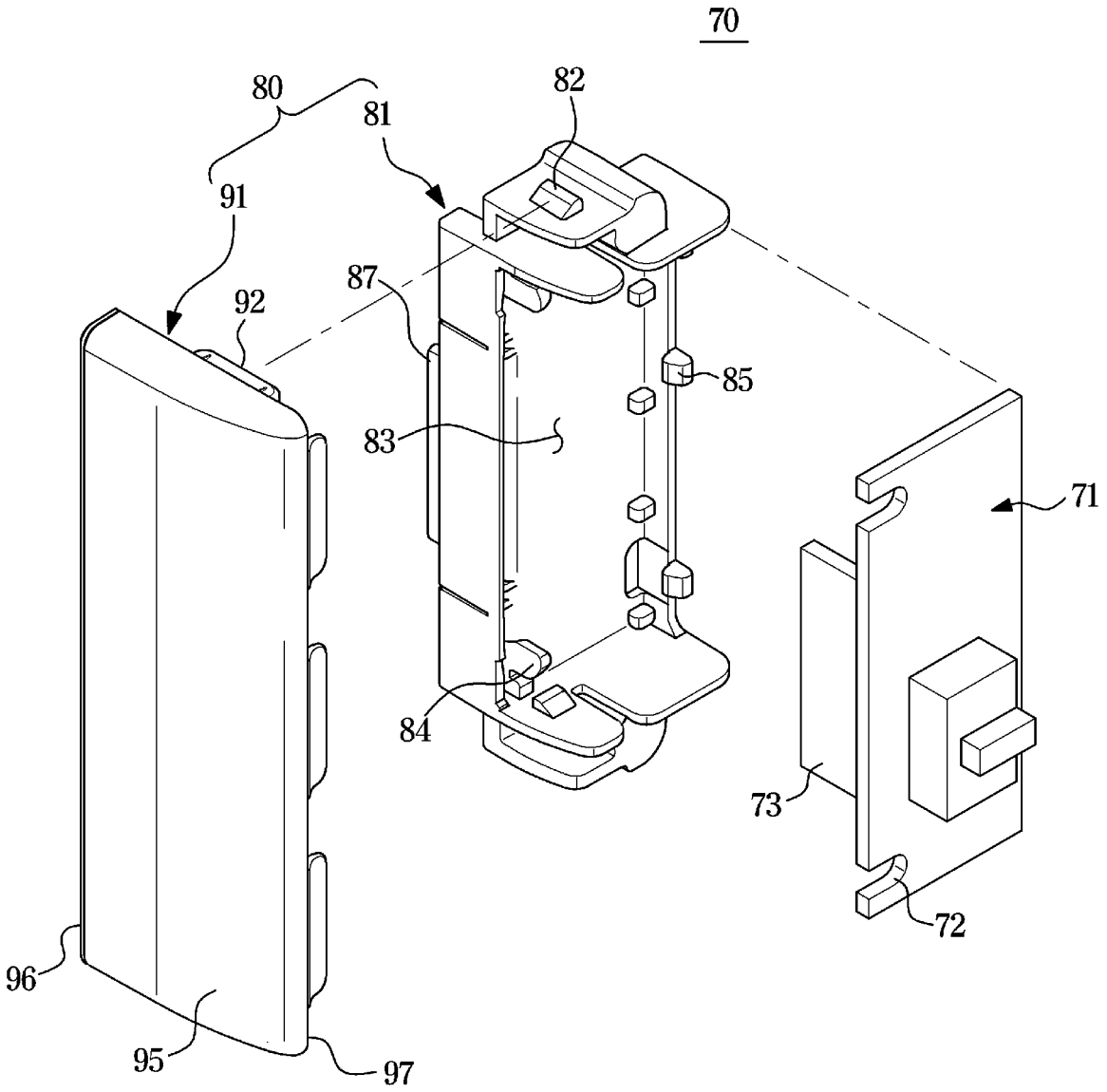
FIG. 20 is an exploded view illustrating the switch module according to an embodiment of the disclosure when viewed from another angle.

FIG. 10 is a view illustrating a state in which the door and a front panel are separated according to an embodiment of the disclosure. FIG. 11 is a view illustrating a state in which the door and the front panel are separated according to an embodiment of the disclosure when viewed from another angle. FIG. 12 is a view illustrating a side member and a side cap of the door according to an embodiment of the disclosure. FIG. 13 is a view illustrating a state in which the side cap of the door and a switch module are separated according to an embodiment of the disclosure. FIG. 14 is a view illustrating a state in which the switch module is mounted on the side cap of the door according to an embodiment of the disclosure. FIG. 15 is a cross-sectional view of a portion of the door according to an embodiment of the disclosure, particularly, a view illustrating a state in which the switch module is removed. FIG. 16 is a cross-sectional view of a portion of the door according to an embodiment of the disclosure, particularly, a view illustrating a state in which the switch module is included. FIG. 17 is a cross-sectional view of a portion of the door according to an embodiment of the disclosure, particularly, a view illustrating a coupling structure between the switch module and a door front member. FIG. 18 is a view illustrating the side cap according to an embodiment of the disclosure. FIG. 19 is an exploded view illustrating the switch module according to an embodiment of the disclosure. FIG. 20 is an exploded view illustrating the switch module according to an embodiment of the disclosure when viewed from another angle.

The doors 21 and 22 and the switch modules 70 and 270 according to an embodiment of the disclosure will be described with reference to FIGS. 10 to 20. Because configurations of the first door 21 and the second door 22 are almost identical, the first door 21 will be described and a description of the second door 22 will be omitted below. In addition, because configurations of the first switch module 70 and the second switch module 270 are the same or almost identical, the first switch module 70 will be described and a description of the second switch module 270 will be omitted below. Descriptions of the first door 21 and the first switch module 70 may be equally applied to the second door 22 and the second switch module 270.

The door 21 may include a door front member 40 forming the front surface of the door 21, a door side member 43 forming the side surface of the door 21, and a door rear member 49 forming the rear surface of the door 21.

According to an embodiment, the door front member 40 and the door side member 43 may be integrally formed with each other. For example, the door front member 40 and the door side member 43 may be formed by bending a single metal plate. A connection between the door front member 40 and the door side member 43 may be formed through a hemming process. Through the hemming process, an end of the door front member 40 and an end of the door side member 43 may be formed to substantially contact each other. A holder mounting groove, to which a holder for coupling with the front panel 31 is mounted, may be formed on the left and right edges of the door front member 40.

According to an embodiment, the door front member 40 and the door side member 43 may be formed separately from each other. The door front member 40 and the door side member 43 may be coupled to each other.

A handle opening 44 and a switch opening 45 may be formed in the door side member 43 (refer to FIG. 12). According to an embodiment, the handle opening 44 and the switch opening 45 may be formed separately and spaced apart from each other. The handle opening 44 may be formed larger than the switch opening 45. However, the size of the handle opening 44 and the switch opening 45 is not limited thereto. The handle opening 44 may be formed behind the switch opening 45.

According to an embodiment, the handle opening 44 and the switch opening 45 may be formed to be connected to each other.

The door 21 may include a side cap 60 coupled to an inner surface of the door side member 43. The side cap 60 may be coupled to the door side member 43 to cover the handle opening 44 and the switch opening 45. Because the side cap 60 is coupled to the inner surface of the door side member 43, the foaming solution may not leak through the handle opening 44 and the switch opening 45 when the insulating material is foamed in the inner space of the door 21.

The side cap 60 may be injection molded of a plastic material. Because the side cap 60 is injection molded from a plastic material, various shapes may be easily formed on the side cap 60. For example, the handle 61 may be recessed in the side cap 60. In addition, a switch mounting space 62 in which the switch module 70 is mounted may be formed in the side cap 60.

The handle 61 may be formed in a size and shape substantially corresponding to the handle opening 44. The handle 61 may be accessible through the handle opening 44. The switch mounting space 62 may be formed to have a size and shape substantially corresponding to the switch opening 45.

A coupling structure for coupling with the door side member 43 may be formed in the side cap 60. The side cap 60 may include a side cap groove 63 and a side cap protrusion 64 for coupling with the door side member 43. The side cap groove 63 may be formed around the handle 61.

The side cap groove 63 may be coupled to a bending member 46 of the door side member 43. The door side member 43 may include the bending member 46 formed by bending an edge of the handle opening 44 toward the inside of the door 21 (refer to FIGS. 12 and 15). The bending member 46 may be inserted into the side cap groove 63. As the bending member 46 is inserted into the side cap groove 63, the door side member 43 and the side cap 60 may be coupled.

In a state in which the bending member 46 is inserted into the side cap groove 63, the side cap protrusion 64 may be coupled to a bending member hole 47 (refer to FIG. 12). The bending member hole 47 may be formed in the bending member 46. As the side cap protrusion 64 is inserted into the bending member hole 47, the door side member 43 and the side cap 60 may be coupled.

Due to this configuration, the side cap 60 formed of a plastic and the door side member 43 formed of a metal may be easily coupled.

The door rear member 49 may be coupled to the door side member 43. The door gasket 27 (refer to FIG. 2) may be provided at an edge portion of the door rear member 49. The door rear member 49 may include a dyke protruding backward, and the door shelf 26 (refer to FIG. 2) may be mounted on the dyke.

The door 21 may include an upper cap 50 and a lower cap 56. The door front member 40, both door side members 43, the door rear member 49, the upper cap 50, and the lower cap 56 may be coupled to form an inner space. A door insulating material may be provided in the inner space.

The upper cap 50 and the lower cap 56 may be injection molded from a plastic material. A structure for detachably coupling the front panel 31 to the front surface of the door 21 may be formed on the upper cap 50 and the lower cap 56.

The switch module 70 may be mounted in the switch mounting space 62 formed in the side cap 60. The switch module 70 may be inserted into the switch mounting space 62 through the switch opening 45 formed in the door side member 43.

When the switch module 70 is mounted in the switch mounting space 62, the switch module 70 may cover the switch opening 45. When the switch module 70 is mounted in the switch mounting space 62, at least a portion of the switch module 70 may be exposed to the outside of the switch mounting space 62. When the switch module 70 is mounted in the switch mounting space 62, at least a portion of the switch module 70 may protrude outward from the door side member 43.

While the switch module 70 is mounted in the switch mounting space 62, the switch module 70 may be fixed through a fastening member S (refer to FIGS. 13, 14, and 17). The fastening member S may pass through the door front member 40 and be coupled to the switch module 70. Accordingly, the switch module 70 may be fixed to the rear surface of the door front member 40. The fastening member S may include various mechanical coupling elements such as screws, bolts, nails, and pins.

A through hole 41 may be formed in the door front member 40 to allow the fastening member S to pass therethrough. A fastening hole 88 to which the fastening member S is fastened may be formed in the switch module 70.

The switch module 70 may be coupled to the door side member 43. One end 48 around the switch opening 45 of the door side member 43 may be coupled to the switch module 70 (refer to FIG. 16). The switch module 70 may include an end coupler 94 coupled to the end 48 of the door side member 43. The end coupler 94 may be formed in a groove or hole shape. The end 48 of the door side member 43 may be inserted into the end coupler 94.

In a state in which the end 48 of the door side member 43 is inserted into the end coupler 94, the above-described fastening member S may be coupled to the switch module 70.

Due to this configuration, the switch module 70 may be conveniently mounted on the door 21. In addition, because the switch module 70 is mounted on the door side member 43 of the door 21, the aesthetics of the door front member 40 may not be reduced.

The switch module 70 may receive a user input for operating the door opening device 100. The switch module 70 may receive a user input by a user's touch. That is, when a user touches the switch module 70, the switch module 70 may generate a signal for operating the door opening device 100.

The switch module 70 may include a circuit board 71 configured to generate a door opening signal according to a change in capacitance. The circuit board 71 may include a printed circuit board on which a circuit configured to detect capacitance change is printed The switch module 70 may include switch cases 80, 81, and 91 on which the circuit board 71 is mounted. A user can touch the switch cases 80, 81, and 91. The switch module 70 may include a transfer member 73 configured to transmit static electricity generated from the switch cases 80, 81, and 91 to the circuit board 71 when a user touches the switch cases 80, 81, and 91.

The transfer member 73 may include a conductive gasket. The transfer member 73 may be formed by covering a surface of the elastic member with a thin metal film or conductive film. The transfer member 73 may electrically connect the circuit board 71 and the switch cases 80, 81, and 91. One end of the transfer member 73 may be in contact with the circuit board 71 and the other end of the transfer member 73 may be in contact with the switch cases 80, 81, and 91.

The switch case 80 may be formed by combining a first switch case 81 and a second switch case 91. However, according to embodiments, the first switch case 81 and the second switch case 91 may be integrally formed.

The first switch case 81 may include a board mounting member 83 on which the circuit board 71 is mounted. The first switch case 81 may include a guide protrusion 84 (refer to FIG. 20) for guiding mounting of the circuit board 71. The guide protrusion 84 may be inserted into a guide groove 72 formed in the circuit board 71 to guide the position of the circuit board 71. The first switch case 81 may include a substrate fixing protrusion 85 provided to fix the circuit board 71 to the board mounting member 83. The first switch case 81 may include the fastening hole 88 to which the fastening member S is fastened.

The transfer member 73 may come into contact with the first switch case 81. The first switch case 81 may include a transfer member receiving member 86 provided to receive the transfer member 73. The transfer member receiving member 86 may be provided to surround the transfer member 73 to fix a position of the transfer member 73 and to effectively receive static electricity from the transfer member 73.

The first switch case 81 may include a touch protrusion 87. The touch protrusion 87 may be touched by a user when the user holds the handle 61. The touch protrusion 87 may pass through the second switch case 91 and be exposed to the outside of the second switch case 91. The touch protrusion 87 may be exposed toward the front of the door 21. When the touch protrusion 87 is touched by a user, static electricity may be directly transmitted to the first switch case 81 without passing through the second switch case 91.

The first switch case 81 may include a first case coupler 82 for coupling with the second switch case 91.

The second switch case 91 may be coupled to the first switch case 81. The second switch case 91 may include a second case coupler 92 coupled to the first case coupler 82.

When the switch module 70 is mounted in the switch mounting space 62, the second switch case 91 may cover the switch opening 45. When the switch module 70 is mounted in the switch mounting space 62, the second switch case 91 may be exposed to the outside from the door side member 43.

The second switch case 91 may include the end coupler 94 to which the end 48 of the door side member 43 around the switch opening 45 is coupled. The second switch case 91 may include a touch protrusion hole 93 through which the touch protrusion 87 of the first switch case 81 passes.

The second switch case 91 may include a touch surface 95. The touch surface 95 may come into contact with the user's hand when the user holds the handle 61 with the user's hand. When the switch module 70 is mounted in the switch mounting space 62, the touch surface 95 may form a part of the side surface of the door 21. The touch surface 95 may be located substantially directly in front of the handle 61.

When the switch module 70 is mounted in the switch mounting space 62, the touch surface 95 may protrude from the door side member 43. The touch surface 95 may include a curved surface. The touch surface 95 may include the curved surface in which an amount of protrusion P from the door side member 43 is reduced from a front end 96 of the touch surface 95 to a rear end 97 of the touch surface 95. With this configuration, when a user holds the handle 61 with his/her hand, the handle 61 may provide an excellent grip feeling and thus the user can comfortably hold the handle 61.

When a user's hand touches the touch surface 95, static electricity may be generated, and the generated static electricity may be transmitted to the circuit board 71 through the second switch case 91, the first switch case 81, and the transfer member 73.

Figure 21:
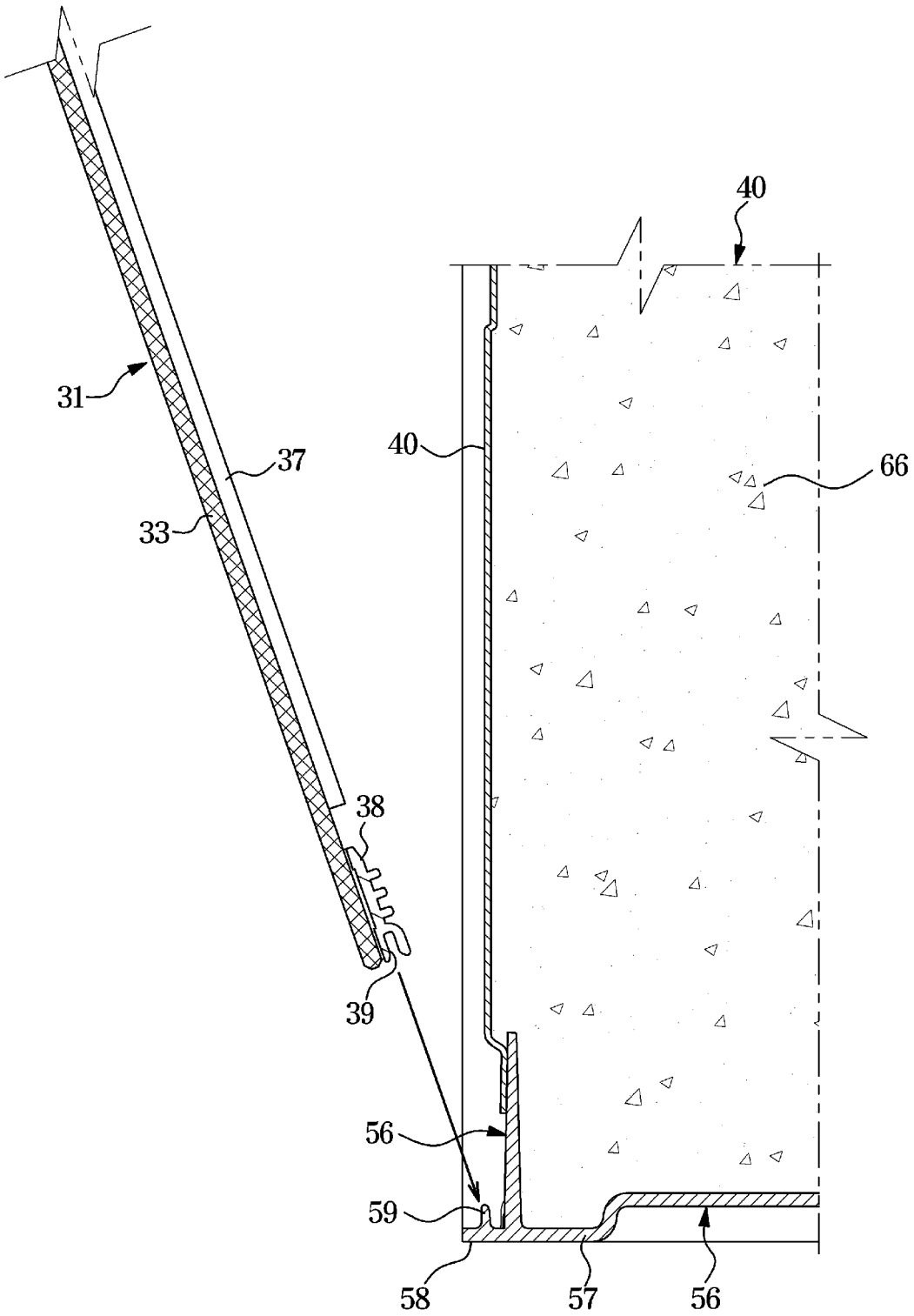
FIG. 21 is a view illustrating an operation of coupling the front panel to the door according to an embodiment of the disclosure, particularly, a view illustrating an operation of coupling a lower end of the front panel to a lower cap.
Figure 22:
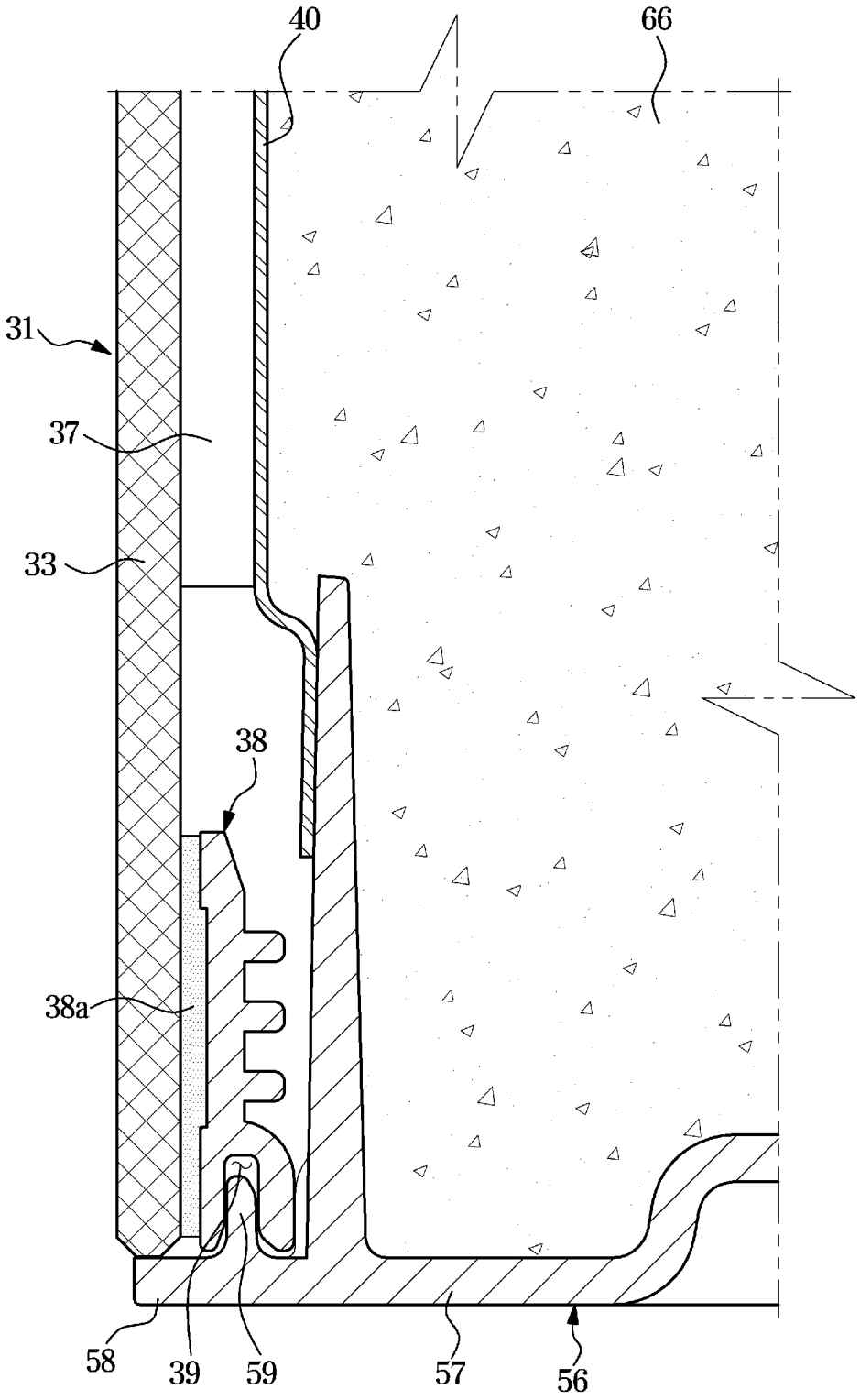
FIG. 22 is a view illustrating the operation of coupling the front panel to the door according to an embodiment of the disclosure, particularly, a view illustrating a state in which the front panel is rotated with respect to the lower cap following the operation of FIG. 21.
Figure 23:
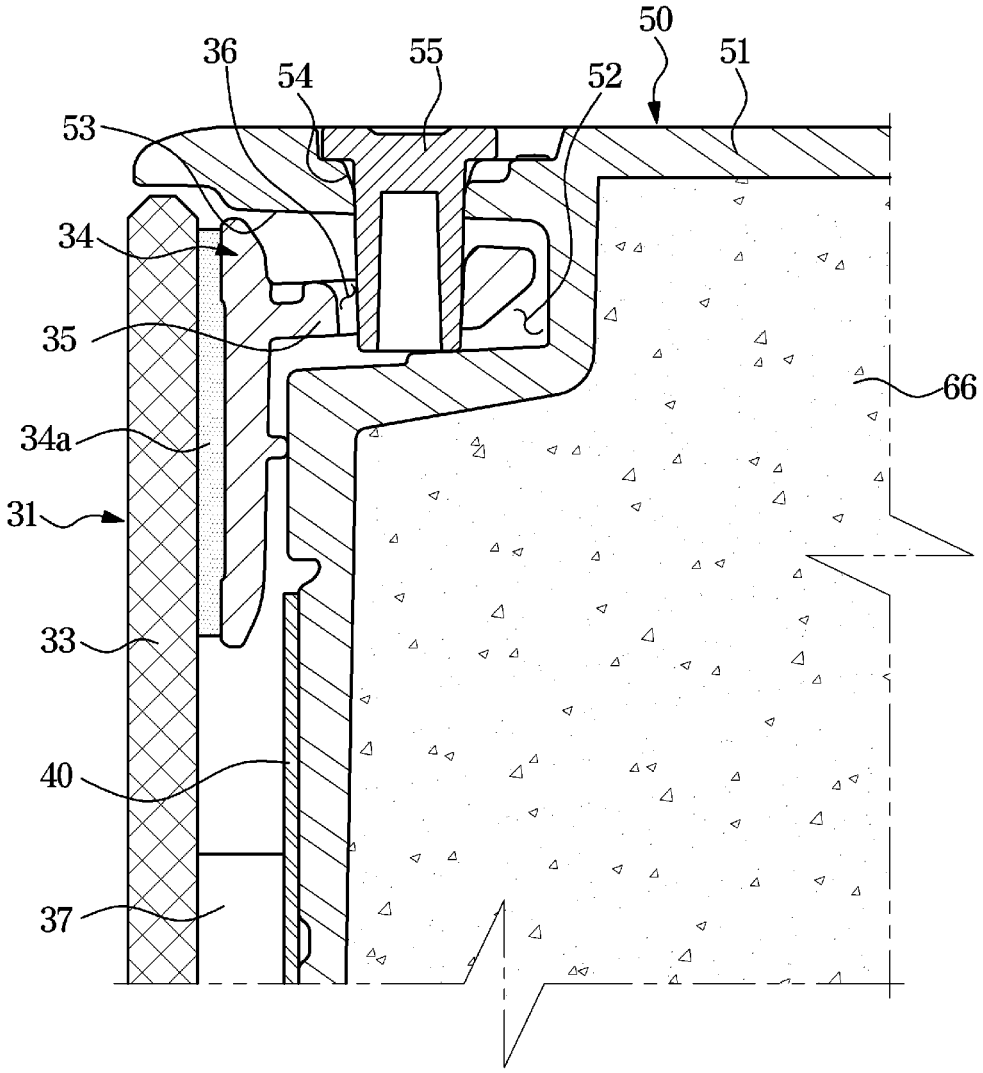
FIG. 23 is a view illustrating the operation of coupling the front panel to the door according to an embodiment of the disclosure, particularly, a view illustrating a state in which a fixer is coupled to an upper end of the front panel and an upper cap following the operation of FIG. 22.

FIG. 21 is a view illustrating an operation of coupling the front panel to the door according to an embodiment of the disclosure, particularly, a view illustrating an operation of coupling a lower end of the front panel to a lower cap. FIG. 22 is a view illustrating the operation of coupling the front panel to the door according to an embodiment of the disclosure, particularly, a view illustrating a state in which the front panel is rotated with respect to the lower cap following the operation of FIG. 21. FIG. 23 is a view illustrating the operation of coupling the front panel to the door according to an embodiment of the disclosure, particularly, a view illustrating a state in which a fixer is coupled to an upper end of the front panel and an upper cap following the operation of FIG. 22.

The front panel will be described with reference to FIGS. 21 to 23.

According to an embodiment, the refrigerator 1 may include the front panels 31 and 32 detachably coupled to front surfaces of the doors 21 and 22. Because the front panel 31 and the front panel 32 include the same or mostly similar configurations, only the front panel 31 will be described.

The front panel 31 may be detachably coupled to the front surface of the door 21. The front panel 31 may be provided to substantially cover the entire front area of the door 21. The front panel 31 may be formed to have a size corresponding to the size of the front surface of the door 21.

The front panel 31 may include a panel body 33, an upper trim 34 provided on an upper end of a rear surface of the panel body 33, and a lower trim 38 provided on a lower end of the rear surface of the panel body 33. The upper trim 34 may be elongated along the upper edge of the panel body 33. The lower trim 38 may be elongated along the lower edge of the panel body 33.

The panel body 33 may be formed of a glass material. However, it is not limited thereto, and the panel body 33 may be formed of an iron plate material or a plastic material.

The upper trim 34 and the lower trim 38 may be provided separately from the panel body 33 and attached to the panel body 33 through adhesives 34*a* and 38*a*. Alternatively, the upper trim 34 and the lower trim 38 may be integrally formed with the panel body 33.

When the front panel 31 is coupled to the door 21, the lower trim 38 may be supported by the lower cap 56. When the front panel 31 is coupled to the door 21, the lower surface of the lower trim 38 may be covered by the lower cap 56. Accordingly, the lower trim 38 may not be exposed to the outside.

The lower trim 38 may include a lower trim groove 39. The lower trim groove 39 may open downward. However, according to embodiments, the lower trim 38 may be formed as a through hole formed to penetrate the lower trim 38 up and down instead of a groove that is open downward. When the front panel 31 is coupled to the door 21, a lower cap protrusion 59 of the lower cap 56 may be inserted into the lower trim groove 39.

The lower cap protrusion 59 may be inserted into the lower trim groove 39 in a state in which the front panel 31 is inclined. In a state in which the lower cap protrusion 59 is inserted into the lower trim groove 39, the front panel 31 may be rotated with respect to the lower cap protrusion 59. That is, the front panel 31 may be moved from an inclined state to an upright state by rotating with respect to the lower cap protrusion 59 in a state in which the lower cap protrusion 59 is inserted into the lower trim groove 39. Alternatively, the front panel 31 may be moved from the upright state to the inclined state in the same way.

When the front panel 31 is coupled to the door 21, the upper trim 34 may be covered by the upper cap 50. Accordingly, the upper trim 34 may not be exposed to the outside.

The upper trim 34 may include a fixer coupler 35. The fixer coupler 35 may be inserted into the upper cap 50. For example, the fixer coupler 35 may be inserted into a trim receiving space 52 of the upper cap 50. A trim opening 53 may be formed on the front side of the trim receiving space 52 of the upper cap 50. The fixer coupler 35 of the upper trim 34 may be inserted into the trim receiving space 52 of the upper cap 50 through the trim opening 53 of the upper cap 50.

The fixer coupler 35 may include a fixer coupling hole 36. The fixer coupling hole 36 may be formed to penetrate the fixer coupler 35 in an up and down direction. A fixer 55 may be coupled to the upper trim 34. For example, the fixer 55 may be coupled to the fixer coupling hole 36 of the upper trim 34. The fixer 55 may be inserted into the fixer coupling hole 36. A fixer opening 54 may be formed on an upper side of the trim receiving space 52 of the upper cap 50. At least a portion of the fixer 55 may be inserted into the trim receiving space 52 of the upper cap 50 through the fixer opening 54 of the upper cap 50.

When the fixer coupler 35 of the upper trim 34 is inserted into the trim receiving space 52 of the upper cap 50, the fixer 55 may be inserted into the trim receiving space 52 of the upper cap 50 through the fixer opening 54 of the upper cap 50, and then the fixer 55 may be coupled to the fixer coupler 35 of the upper trim 34. With this configuration, the front panel 31 may be detachably coupled to the door 21.

The front panel 31 may include a magnet 37 for coupling with the door 21. The magnet 37 may be provided to extend vertically on left and right edge portions of the panel body 33. With magnetic force, the magnet 37 may be in close contact with the door front member 40 formed of a metal.

The lower cap 56 may form a lower surface of the door 21. The lower cap 56 may include a lower cap body 57. The lower cap 56 may include a lower cap support 58 protruding forward from a lower portion of the lower cap body 57. The lower cap support 58 may be formed to protrude forward from the door front member 40. The lower cap support 58 may support the lower end of the front panel 31. The lower cap 56 may include the lower cap protrusion 59 protruding upward from the lower cap support 58.

The upper cap 50 may form the upper surface of the door 21. The upper cap 50 may include an upper cap body 51. The upper cap 50 may include the trim receiving space 52. The upper cap 50 may include the trim opening 53 formed on the front side of the trim receiving space 52 to allow the upper trim 34 of the front panel 31 to be inserted into the trim receiving space 52. The upper cap 50 may include the fixer opening 54 formed on the upper side of the trim receiving space 52 to allow the fixer 55 to be inserted into the trim receiving space 52. The fixer opening 54 may be formed at a position corresponding to the fixer coupling hole 36 of the upper trim 34.

As described above, the switch module 70 is provided on the door side member 43 of the door 21, and thus when the front panel 31 is coupled to the front surface of the door 21, the switch module 70 may not be covered by the front panel 31. That is, the switch module 70 may be easily touched when a user holds the handle 61 regardless of whether the front panel 31 is coupled or not.

On the other hand, when the front panel 31 is coupled to the front surface of the door 21, the fastening member S provided to couple the switch module 70 to the door front member 40 may be covered by the front panel 31 and thus not be exposed to the outside (refer to FIG. 17). Therefore, when the front panel 31 is coupled to the door 21, the fastening member S may not be exposed, and thus the aesthetics may be further improved and the fastening member S may be prevented from being loosened.

Figure 24:
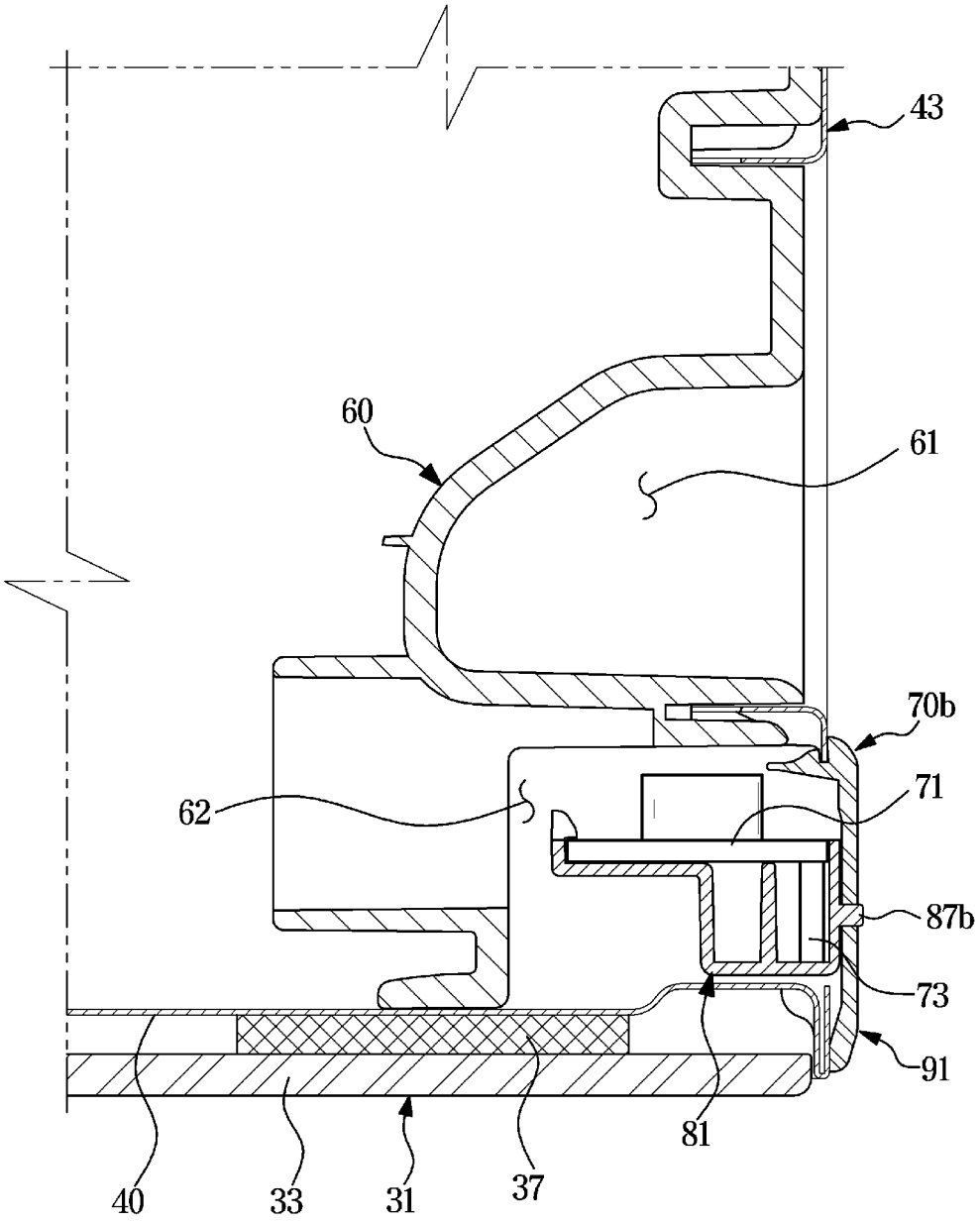
FIG. 24 is a view illustrating a mounting structure of a switch module according to an embodiment of the disclosure.
Figure 25:
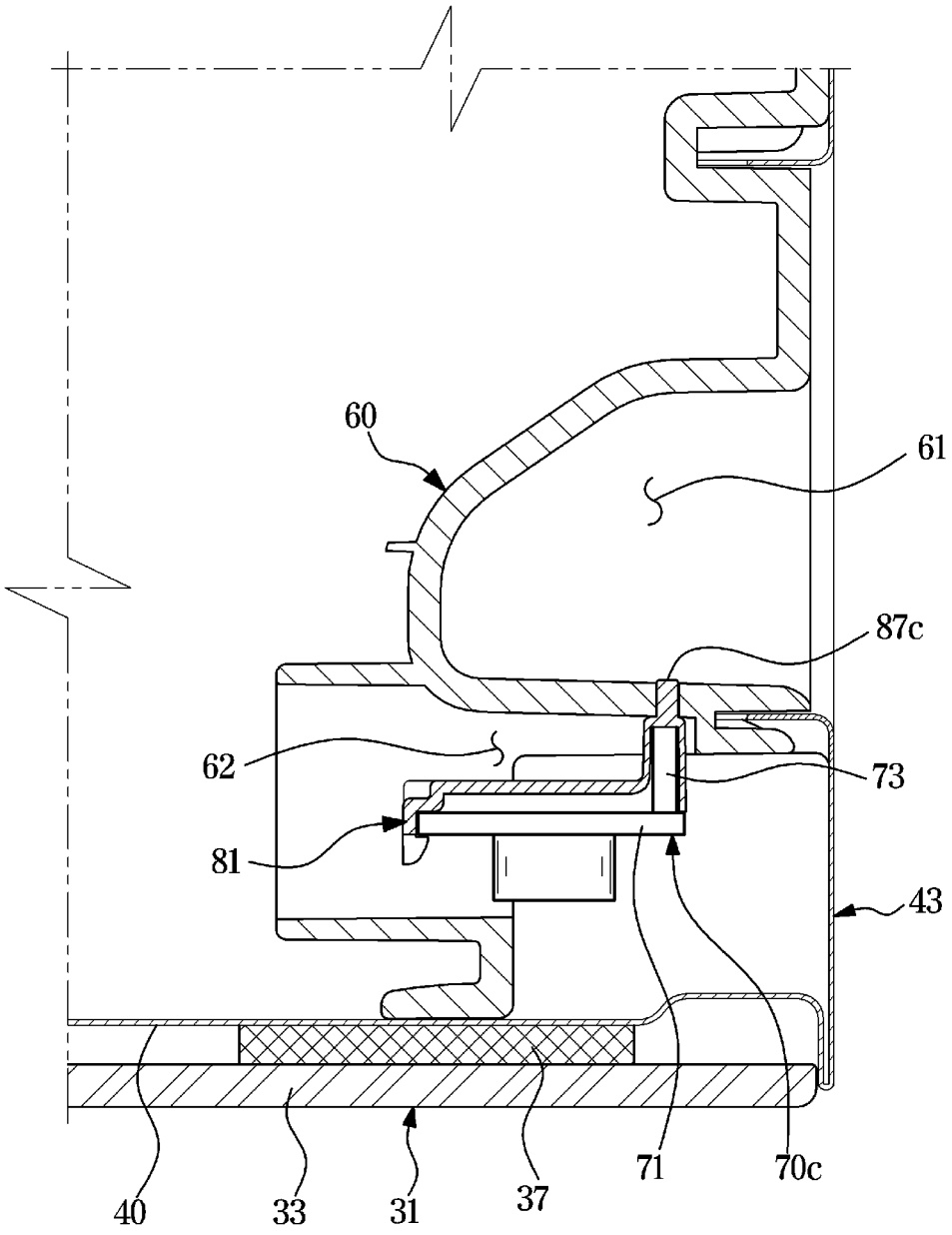
FIG. 25 is a view illustrating a mounting structure of a switch module according to an embodiment of the disclosure.
Figure 26:
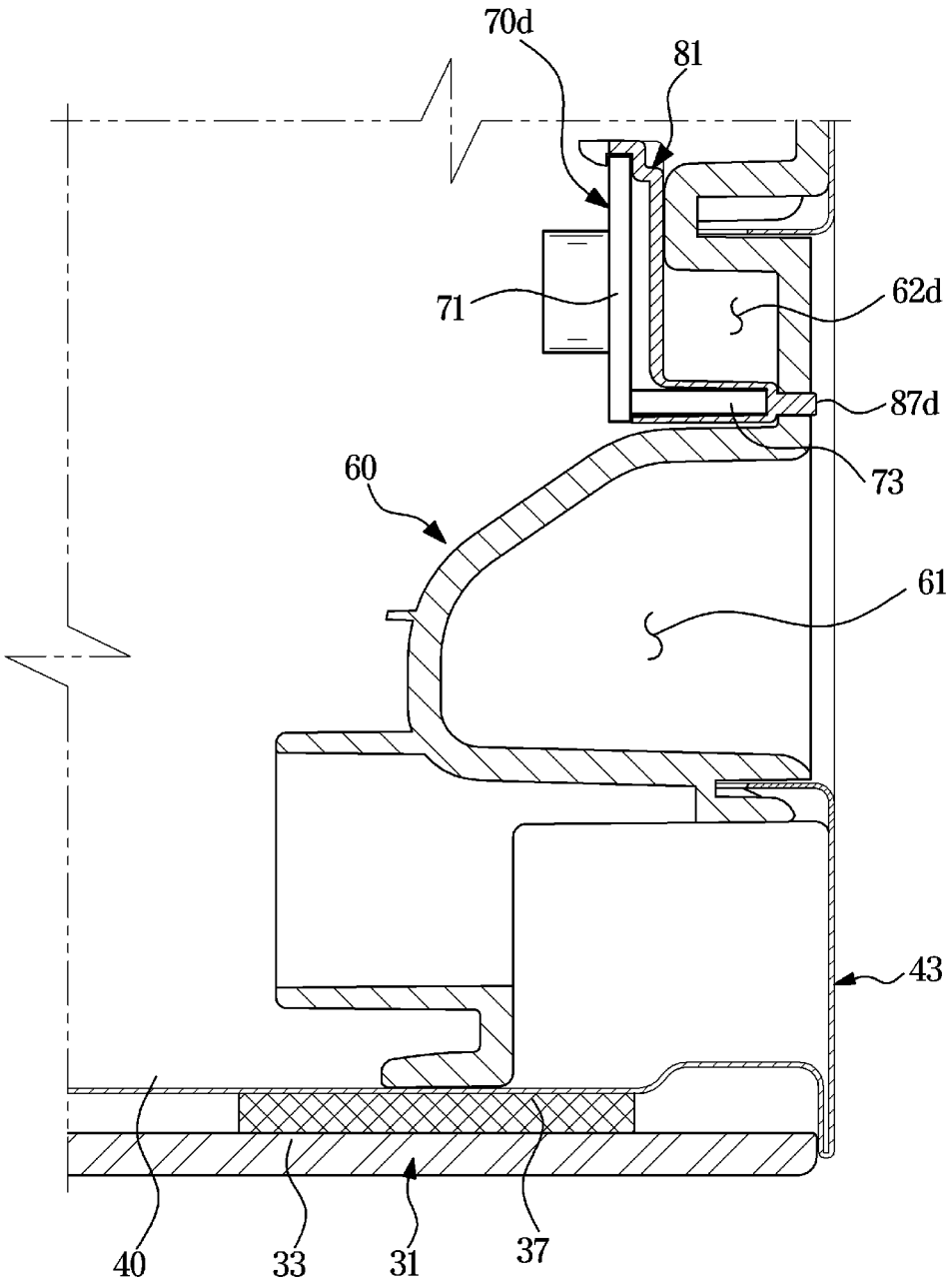
FIG. 26 is a view illustrating a mounting structure of a switch module according to an embodiment of the disclosure.

FIG. 24 is a view illustrating a mounting structure of a switch module according to an embodiment of the disclosure. FIG. 25 is a view illustrating a mounting structure of a switch module according to an embodiment of the disclosure. FIG. 26 is a view illustrating a mounting structure of a switch module according to an embodiment of the disclosure.

A mounting structure of the switch module according to an embodiment of the disclosure will be described with reference to FIGS. 24 to 26. Descriptions of the same components as those of the above-described embodiment are omitted.

Touch protrusions 87*b*, 87*c*, and 87*d* of switch modules 70*b*, 70*c*, and 70*d* may be exposed in various directions so as to be more easily touched.

For example, a touch protrusion 87*b* of a switch module 70*b* may be exposed toward the lateral side of the door 21 (refer to FIG. 24).

A touch protrusion 87*c* of a switch module 70*c* may be exposed toward the rear side of the door 21 (refer to FIG. 25). That is, the touch protrusion 87*c* of the switch module 70*c* may be exposed toward the handle 61.

A touch protrusion 87*d* of a switch module 70*d* may be exposed toward the lateral side of the door 21 (refer to FIG. 26). The switch module 70*d* may be provided behind the handle 61.

Figure 27:
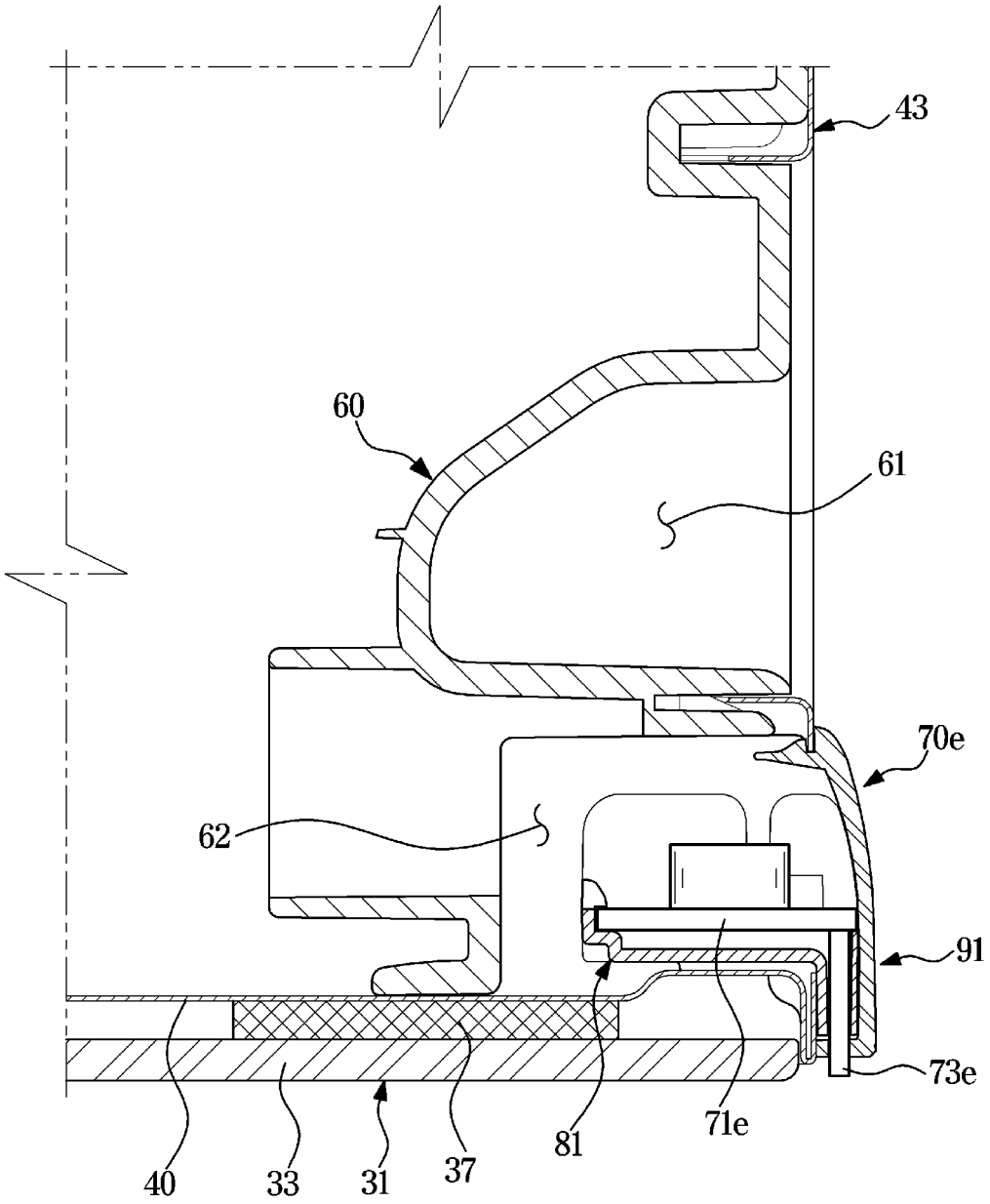
FIG. 27 is a view illustrating a mounting structure of a switch module according to an embodiment of the disclosure.

FIG. 27 is a view illustrating a mounting structure of a switch module according to an embodiment of the disclosure.

A switch module according to an embodiment of the disclosure will be described with reference to FIG. 27. Descriptions of the same components as those of the above-described embodiment are omitted.

The switch module may receive user input through various methods other than a method of detecting a change in capacitance according to a touch.

According to an embodiment, a switch module 70*e* may include a mechanical push switch. The switch module 70*e* may include a micro switch 71*e* including an operation button 73*e* and configured to be operated by being pressed by the operation button 73*e*. The operation button 73*e* may be arranged to be exposed to the outside of the switch module 70*e*. When a user holds the handle 61, the micro switch 71*e* may generate a door opening signal as the user presses the operation button 73*e* of the micro switch 71*e*. Alternatively, the switch module may include a mechanical switch such as a dial type or a toggle type. In addition, the switch module may include a non-contact switch such as a reed switch operated by a magnet, a proximity sensor switch including a proximity sensor, and a TOF switch including a TOF sensor using an infrared wavelength.

The above-mentioned disclosure is not applied only to the above-described refrigerator, and may be applicable to a home appliance including a main body including a cavity, which is an internal space for performing a specific function, and a door configured to open and close the cavity, and the door thereof.

For example, the above-mentioned disclosure may be applied to a cooking appliance including a cooking chamber, a dishwasher including a washing chamber, a dryer including a drying chamber, a clothes treatment device including a clothes treatment chamber, and an air conditioner including a heat exchange chamber in which a heat exchanger is disposed.

Although several embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body comprising a storage compartment;

a door rotatably coupled to the main body and configured to open and close the storage compartment; and a door opening device provided in the main body and configured to open the door, wherein the door comprises:

a door front member forming a front surface of the door;

a door side member forming a side surface of the door and having a first opening and a second opening that is spaced apart from the first opening;

a side cap coupled to an inner surface of the door side member and comprising a handle that is recessed and a switch mounting space; and a switch module mounted in the switch mounting space through the first opening and configured to receive an input for operating the door opening device, wherein the handle of the side cap is accessible through the second opening.

2. The refrigerator of claim 1, wherein at least a portion of the switch module protrudes outward from the door side member.

3. The refrigerator of claim 1, wherein the switch module covers the first opening.

4. The refrigerator of claim 1, further comprising:

a fastening member penetrating the door front member and coupling the switch module to the door front member.

5. The refrigerator of claim 1, wherein the switch module comprises an end coupler into which an end of the door side member is coupled.

6. The refrigerator of claim 1, wherein the switch module comprises:

a circuit board configured to output a door opening signal according to a change in a capacitance; and a switch case to which the circuit board is mounted, and covering the first opening.

7. The refrigerator of claim 6, wherein the switch module further comprises a transfer member between the circuit board and the switch case and electrically connecting the circuit board and the switch case.

8. The refrigerator of claim 7, wherein the switch case comprises:

a first switch case comprising a board mounting member on which the circuit board is mounted, the first switch case contacting the transfer member; and a second switch case coupled to the first switch case and covering the first opening.

9. The refrigerator of claim 8, wherein the second switch case comprises a touch surface configured to be touched when a user holds the handle, and wherein the touch surface comprises a curved surface in which an amount of protrusion from the door side member is reduced from a front end to a rear end of the touch surface.

10. The refrigerator of claim 8, wherein the first switch case comprises a touch protrusion which penetrates the second switch case and is exposed to an outside of the second switch case.

11. The refrigerator of claim 1, wherein the door side member comprises a bending member protruding toward an inside of the door from one edge of the second opening, and wherein the side cap comprises a side cap groove configured to allow the bending member to be inserted thereinto.

12. The refrigerator of claim 11, wherein the bending member comprises a bending member hole, and wherein the side cap further comprises a side cap protrusion in the side cap groove to be coupled to the bending member hole.

13. The refrigerator of claim 1, further comprising:

a front panel detachably coupled to a front side of the door, wherein the switch module is exposed without being covered by the front panel when the front panel is coupled to the front side of the door.

14. The refrigerator of claim 4, further comprising:

a front panel detachably coupled to a front side of the door, wherein the fastening member is covered by the front panel when the front panel is coupled to the front side of the door.

* * * * *